US006640503B1

(12) United States Patent
Evensen et al.

(10) Patent No.: US 6,640,503 B1
(45) Date of Patent: Nov. 4, 2003

(54) WATERPROOF ROOF DECK POST CONSTRUCTION AND METHOD

(75) Inventors: Lawrence P. Evensen, 29254 Greenwater Rd., Malibu, CA (US) 90265; Mark Andersen, Woodland Hills, CA (US); Richard Spindel, Granada Hills, CA (US)

(73) Assignee: Lawrence P. Evensen, Westlake Village, CA (US)

( * ) Notice: Subject to any disclaimer, the term of this patent is extended or adjusted under 35 U.S.C. 154(b) by 219 days.

(21) Appl. No.: 09/628,598

(22) Filed: Jul. 28, 2000

Related U.S. Application Data

(63) Continuation-in-part of application No. 09/240,807, filed on Feb. 1, 1999.

(51) Int. Cl.[7] ..... E04D 3/38

(52) U.S. Cl. ..... 52/60; 52/58; 52/199; 52/741.4; 277/602; 277/607; 277/625; 277/644; 285/42

(58) Field of Search ..... 52/199, 58, 59, 52/60, 219, 741.4; 285/83, 82, 42; 277/212, 602, 607, 625, 626, 644

(56) References Cited

U.S. PATENT DOCUMENTS 1,540,192 A 6/1925 Smith (List continued on next page.)

OTHER PUBLICATIONS

Prior Art Publication entitled "All Style Industries Waterproof Line Set Collars", one page.
Prior Art Publication entitled "Been Sued Yet?" by All Style Industries, two pages.

*Primary Examiner*—Carl D. Friedman
*Assistant Examiner*—Jennifer I. Thissell
(74) *Attorney, Agent, or Firm*—Oppenheimer Wolff & Donnelly LLP

(57) ABSTRACT

A deck post (or brace) having a non-circular cross-section is secured to a roof deck. A lead pipe jack (sleeve) is slid over the post. A waterproofing assembly having a collar and a skirt is provided; the collar has an opening with generally the same non-circular cross-section as that of the post. The collar opening is positioned on the deck post, and the unit is slid down the post until the collar is at the top of the sleeve, the skirt extending down over the sleeve. A clamp is then positioned and tightened around the collar to provide a watertight seal on the deck post. When the post is already installed on a roof deck and the sleeve and the waterproofing assembly cannot be slid into place on the post, a modified retrofit waterproofing assembly and sleeve are used to provide the waterproofing. The modified sleeve is a split lead flashing jack with an open seam on one side. The sleeve is opened up, wrapped around the post and soldered closed. The modified waterproofing assembly has a split joint through the skirt and collar. To position this assembly on the post at the top of the split lead flashing jack, the joint is opened up, the assembly wrapped around the post and the slip joint closed with a watertight flap. A locking closure can be provided having a locking clasp and a locking slot. Another alternative waterproofing assembly forms the collar as a plug separate from the skirt; the skirt is opened and the plug inserted therein. This arrangement allows a plug having the desired opening configuration to be selected from an inventory of different plugs and used with a single skirt design. Another alternative of the waterproofing assembly provides a series of flanged tabs on the top edge of the collar for connecting to the collar plug. The flanged tabs may each have a projection on them which increases the pull-out resistance between a connected skirt and collar. The collar plug may also have a series of cavities which line up with the flanged tabs of the skirt. The collar plug may have a recess for the clamp. As an alternative assembly, multiple skirts can be connected together using their locking clasps and locking slots and the resulting larger skirt can then be connected to a collar.

47 Claims, 20 Drawing Sheets

U.S. PATENT DOCUMENTS

| | | | |
|---|---|---|---|
| 3,977,137 | A | 8/1976 | Patry |
| 4,120,129 | A | 10/1978 | Nagler et al. |
| 4,211,423 | A | 7/1980 | Resech |
| 4,372,585 | A | 2/1983 | Evora |
| 4,453,562 | A | 6/1984 | Palkovics |
| 4,570,943 | A | 2/1986 | Houseman et al. |
| 4,897,974 | A | 2/1990 | Lane |
| 4,937,991 | A | 7/1990 | Orth |
| 5,010,700 | A | 4/1991 | Blair |
| 5,067,291 | A | 11/1991 | Evensen |
| 5,176,408 | A | 1/1993 | Pedersen |
| 5,222,334 | A | 6/1993 | Hasty |
| 5,226,263 | A | 7/1993 | Merrin et al. |
| 5,347,776 | A | 9/1994 | Skoff |
| 5,536,048 | A | 7/1996 | Orr |
| 5,588,267 | A | 12/1996 | Rodriguez et al. |
| 5,603,187 | A | 2/1997 | Merrin et al. |
| 5,605,019 | A | 2/1997 | Maziekien et al. |
| 5,778,611 | A | 7/1998 | Michel |
| 5,970,667 | A | 10/1999 | Thaler |

128
238
226
210
246
214
218
222
242

128
260
11
214

218
222
254
11
250
234
226'
222
210
230
218
128

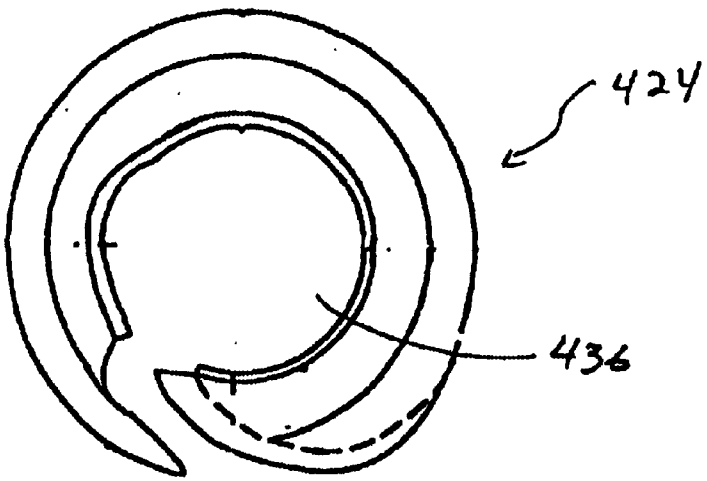
FIG. 21
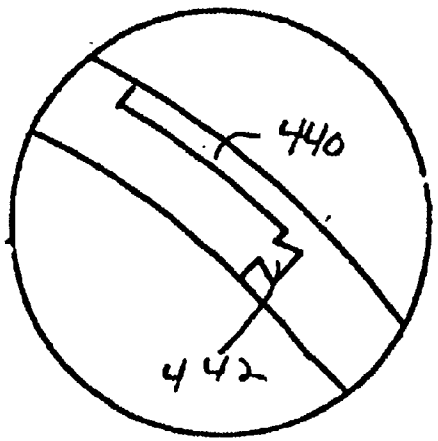
FIG. 22
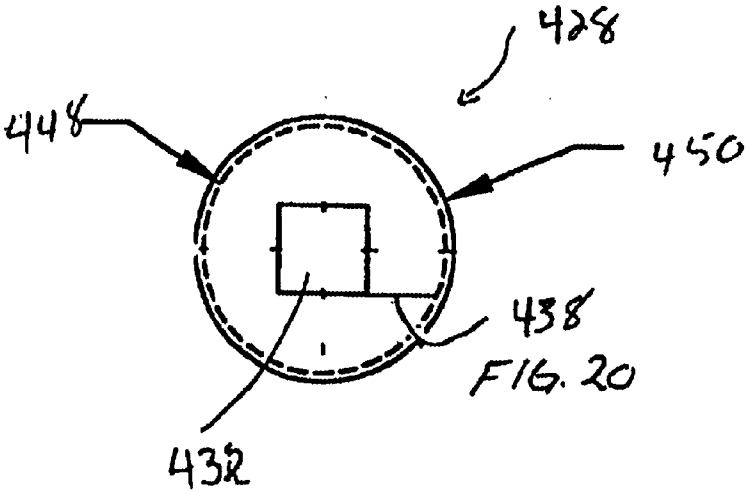
FIG. 20
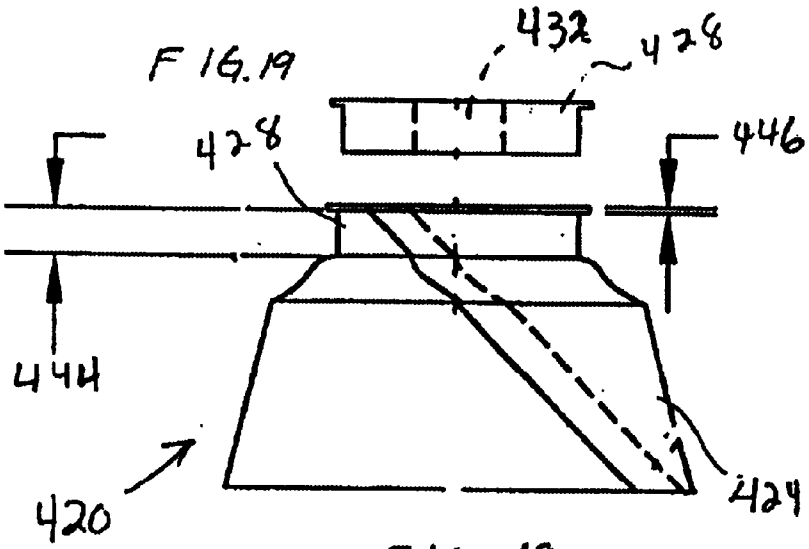
FIG. 19
FIG. 18

WATERPROOF ROOF DECK POST CONSTRUCTION AND METHOD

CROSS-REFERENCE TO RELATED APPLICATION

This is a continuation-in-part of copending application Ser. No. 09/240,807, filed Feb. 1, 1999 and whose entire contents are herein incorporated by reference.

BACKGROUND OF THE INVENTION

The present invention relates to constructions, assemblies and methods for installing and waterproofing roof deck posts, and particularly those having non-circular cross-sections.

The tops of buildings or roof decks are often used to mount various items, which typically support the use or function of the building or benefit the building's occupants in some way. These items include signs, fences, helicopter landing zones, equipment supports and even swimming pools.

When a fence, for example, is installed on top of a building, it must be installed securely so that it will not fall or blow off of the building. Additionally, the support members or posts of the fence must be attached in such a way as to maintain the water integrity of the roof. If the fence supports are bolted into the roof deck, each support will cut through or penetrate the building roof jeopardizing the water integrity of the roof unless adequate waterproofing measures are taken.

A waterproofing construction of the prior art used when the support or post is round is shown in FIG. 1 generally at 50. Referring thereto, the round post 54 is secured to structural framing 58, and is provided to support another structure such as fencing or a structural frame. An umbrella overlapping jack 64 is used to waterproof the support. The pipe jack 64 is a cone that fits snugly around the penetration and creates a waterproof seal above the roof line. FIG. 1 shows a sheet metal roof jack 66 extending at least eight inches above the roofing, and the umbrella pipe jack 64 overlaps the roof jack by a radius of three to four inches. A drawband 70 secures the upper collar portion of the pipe jack 64 to the round post 54, and caulk with sealant is applied around the top circumference. Construction 50 works where the projection or post is round; however, if the post is other than round, the pipe jack does not fit snugly and leaks result.

Thus, for other than round posts, another waterproofing construction is used, an example of which is depicted in FIG. 2 and is commonly referred to as "Pitch Pocket." This term describes the encasing of an odd-shaped penetration (such as a steel angle iron support) in a pool of asphalt that is held in a metal bowl mounted onto the roof. When the asphalt dries or cools the penetration located inside of it is tightly encased to prevent water penetrating into the building.

Referring to FIG. 2, a method of installing the Pitch Pocket will now be described with the construction being shown generally at 76. A steel angle iron brace (support or post) 80 with a four hole mounting plate 84 welded thereto is bolted with bolts 88 to a roof deck 90. A sheet metal contractor slides a four-sided metal pitch pan 92 over the top of the brace 80. The pan 92, which is at least two inches deep, hangs loose waiting for a later installation step. The roofing contractor installs first ply layers (typically three) of roofing materials under the pitch pan 92 and onto the entire building roof. He then nails the flange 94 of the pan 92 onto the roof deck and through the ply layers. Roofing plies will be striped or layered over the flange 94 to laminate the flange between the roofing plies. A finish coat of roofing materials 96, such as gravel or granule rolled roofing, is installed. Hot asphalt 98 or other pourable sealer is then poured into the pitch pan 92 until full and with a minimum two inch depth, and the asphalt is allowed to cool.

Pitch Pockets (76) work well until the asphalt shrinks or cracks and the pan or concave bowl fills with water. This cracking can be caused by the sun's direct heat, by impact on the post construction, by strong winds or by the building shaking as from an earthquake. When the cracks form, the water in the pocket is funneled into the building, resulting in the problem which the Pitch Pocket was specifically provided to prevent. Also, since the post is fixed in place by the asphalt, when a strong force is exerted on the post, the asphalt around the post compresses, loosening the securement of the post relative to the roof, and requiring repair.

SUMMARY OF THE INVENTION

According to one embodiment of a waterproof roof deck post of the invention, a deck post having a non-circular cross-section is secured relative to a roof deck. A sleeve surrounds the lower portion of the deck post. A waterproofing assembly has a collar and a skirt. The collar has an opening that is generally the same non-circular cross-section as that of the deck post. The deck post is disposed in the collar's opening. The collar is formed as a plug that is separate from the skirt. The collar is adapted to be fitted into an opening in the skirt. The skirt may be connected to the collar with a series of flanged tabs on the top portion of the skirt being inserted into a series of tab receiving cavities in the collar. The tabs may have projections used to increase the tabs' pull-out resistance. The collar surrounds the deck post above the top of the sleeve. The skirt extends down from the collar and out over the top of the sleeve. The skirt may have a split joint which locks together with a clasp and a locking slot on the skirt. The skirt may even be made up of a series of smaller skirt pieces that are joined together using their clasps and locking slots. A band surrounds the collar (perhaps situated in a recess formed in the collar of that purpose) and secures the collar to the deck post in a generally watertight manner.

According to another definition of the invention, disclosed herein are an improved waterproof deck post construction and method and a waterproofing assembly (or watertight umbrella) useful therein. The assembly has a collar with an opening therethrough and a skirt hanging down from the collar. The opening is configured to match the cross-sectional shape of the deck post, and this invention is thereby particularly well suited for deck posts which are not round. The assembly is preferably an elastomeric material or specifically is EPDM molded rubber.

The post is secured to the roof deck. A flanged sleeve is slid over the post, and the flange secured to the roof deck. The flanged sleeve can be a lead jack such as are used today on stink pipes and vent pipes. The waterproofing assembly is slid onto the post. With the collar surrounding the post just above the top of the sleeve and the skirt extending down over the top of the sleeve, a band is secured around the collar securing the collar in a watertight manner to the post. The band is preferably a hose clamp.

When the post is already secured to the deck and it is not convenient to slide the waterproofing assembly down over the post, an alternative embodiment of the waterproofing assembly of this invention is used. This embodiment has a split joint through the skirt and the collar which allows the unit to be opened up and wrapped around the post. A watertight flap of the unit seals the joint closed. In this construction, a split lead flashing jack can be used as the flanged sleeve. The flashing jack is opened up and wrapped around the post and its seam then soldered closed.

The shape of the opening of the collar is selected to match the shape of the outside surface of the post. For example, it can be an L or a square shape. The skirt can have the same configuration for all post shapes. Thus, another embodiment of the waterproofing assembly constructs the skirt and collar as separate pieces with an inventory of collars having different opening shapes provided. The collar with the desired opening shaped to match the post being used will be selected and plugged into the skirt. In other words, the detachable EPDM collars or inserts are interchangeable to allow various geometric shapes. This plug-type collar and skirt can have split joints allowing them to be wrapped around the post. Additionally, the collar can have a longer configuration to accommodate two hose clamps, one above the other, if desired.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 18 is a view similar to FIG. 14 illustrating an alternative waterproofing assembly of the present invention;

FIG. 19 is a side elevational view of the plug of the assembly of FIG. 18;

FIG. 20 is a top plan view of the plug of FIG. 19;

FIG. 21 is a top plan view of the assembly of FIG. 18 without the plug and in an open position;

FIG. 22 is an enlarged view of a portion of the seam of FIG. 18;

DETAILED DESCRIPTION OF PREFERRED EMBODIMENTS OF THE INVENTION

Figure 1:
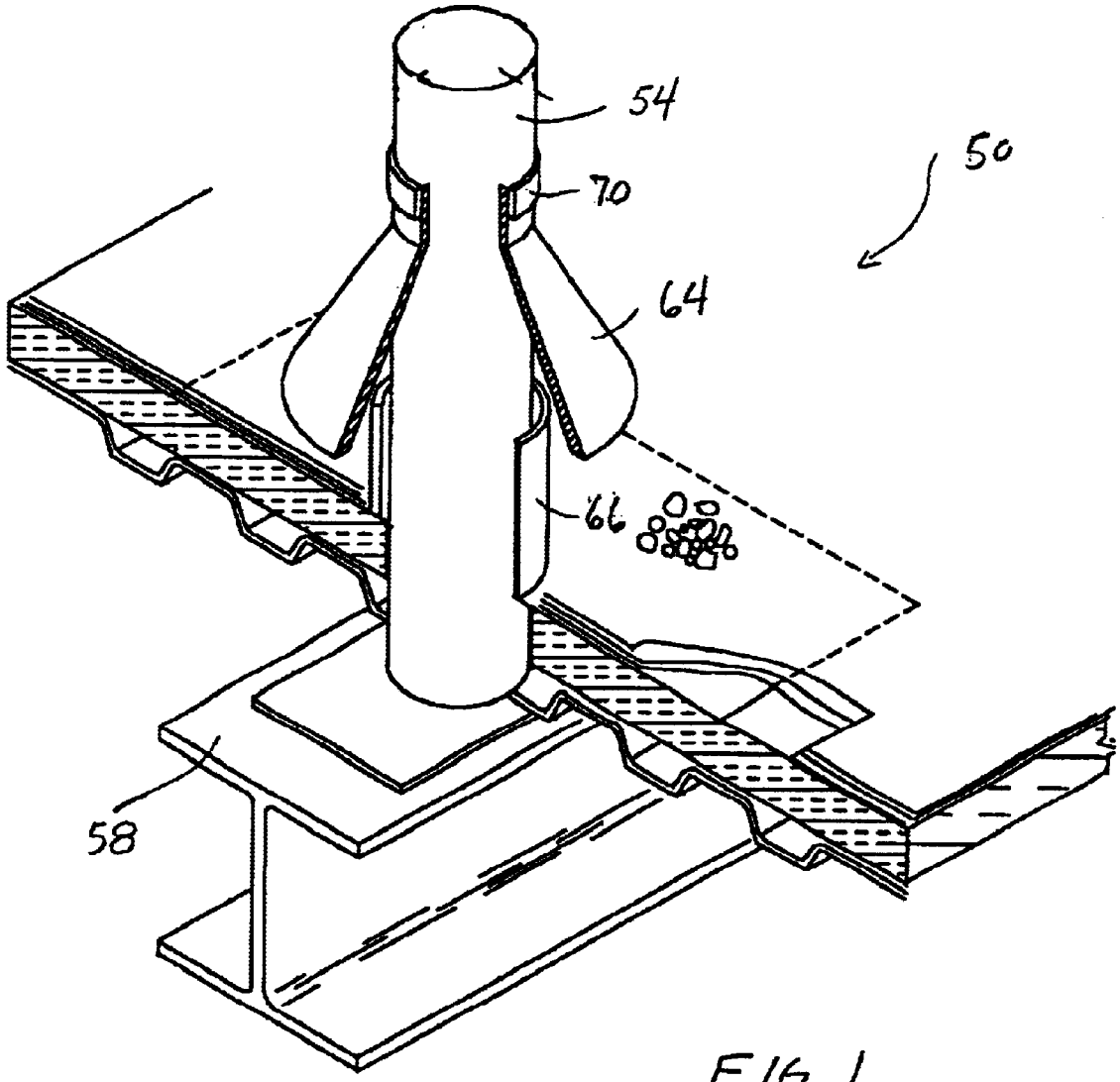
FIG. 1 (PRIOR ART)
FIG. 1 is a perspective cut-away view of a round post roof-mounted construction of the prior art.

Referring to the drawings, a waterproof roof deck post construction of the present invention is illustrated generally at 100. The method of constructing it is quick and easy. The steel contractor bolts the post 104 with a four-hole mounting bracket 108 welded thereto to the roof deck 112 using bolts 116. The post 104 can have generally any cross-sectional shape (unlike the prior art construction of FIG. 2) including non-round shapes. An "L" shape is illustrated by post 104, which more specifically is an angle iron brace. The steel contractor then slides a lead pipe jack 124, a waterproofing assembly 128 of the present invention and a stainless steel hose clamp 132 over the top of the brace or post 104 and lets them fall to the deck for later installation.

Figure 6:
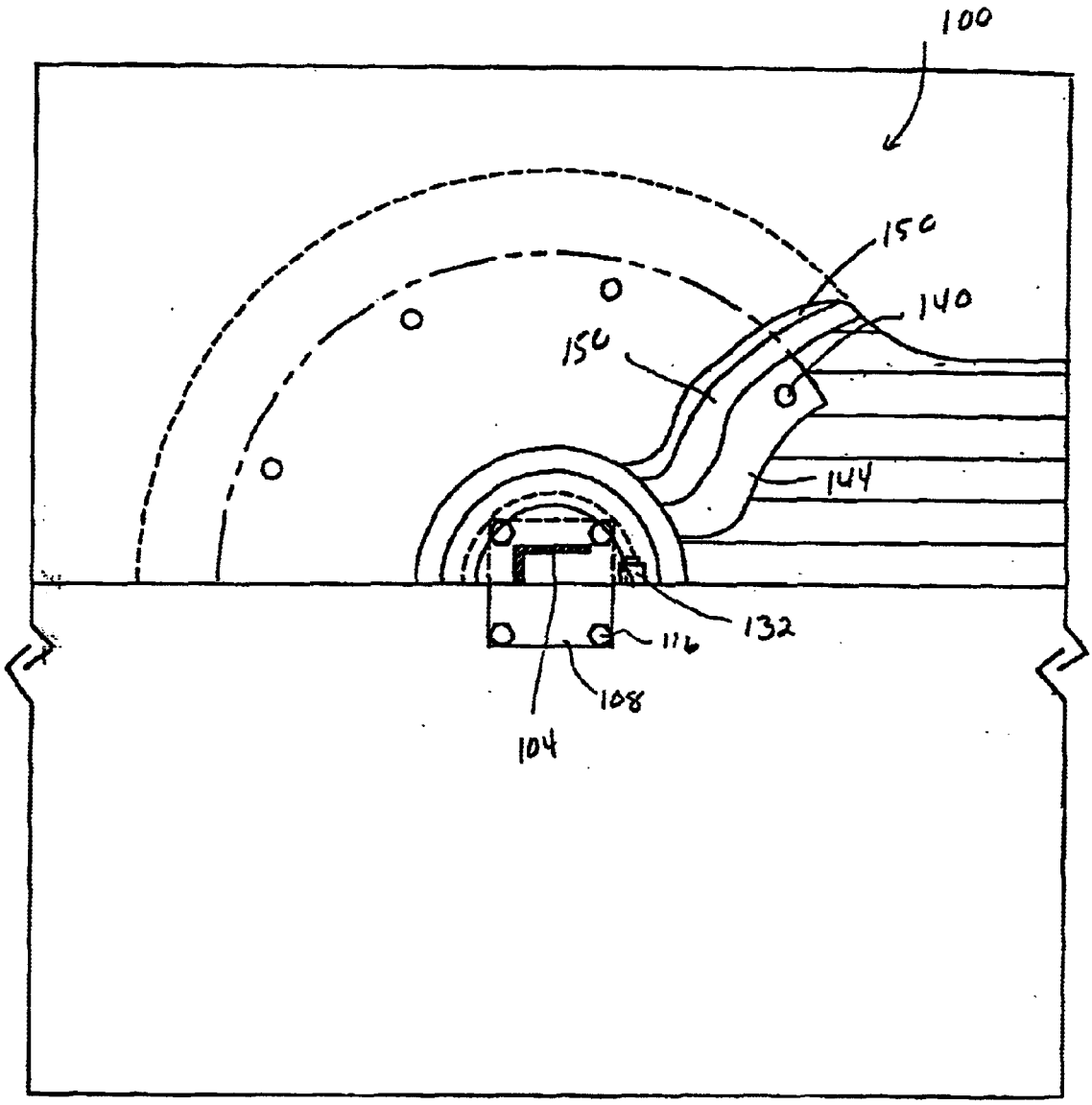
FIG. 6 is an enlarged top plan view of FIG. 5.
Figure 7:
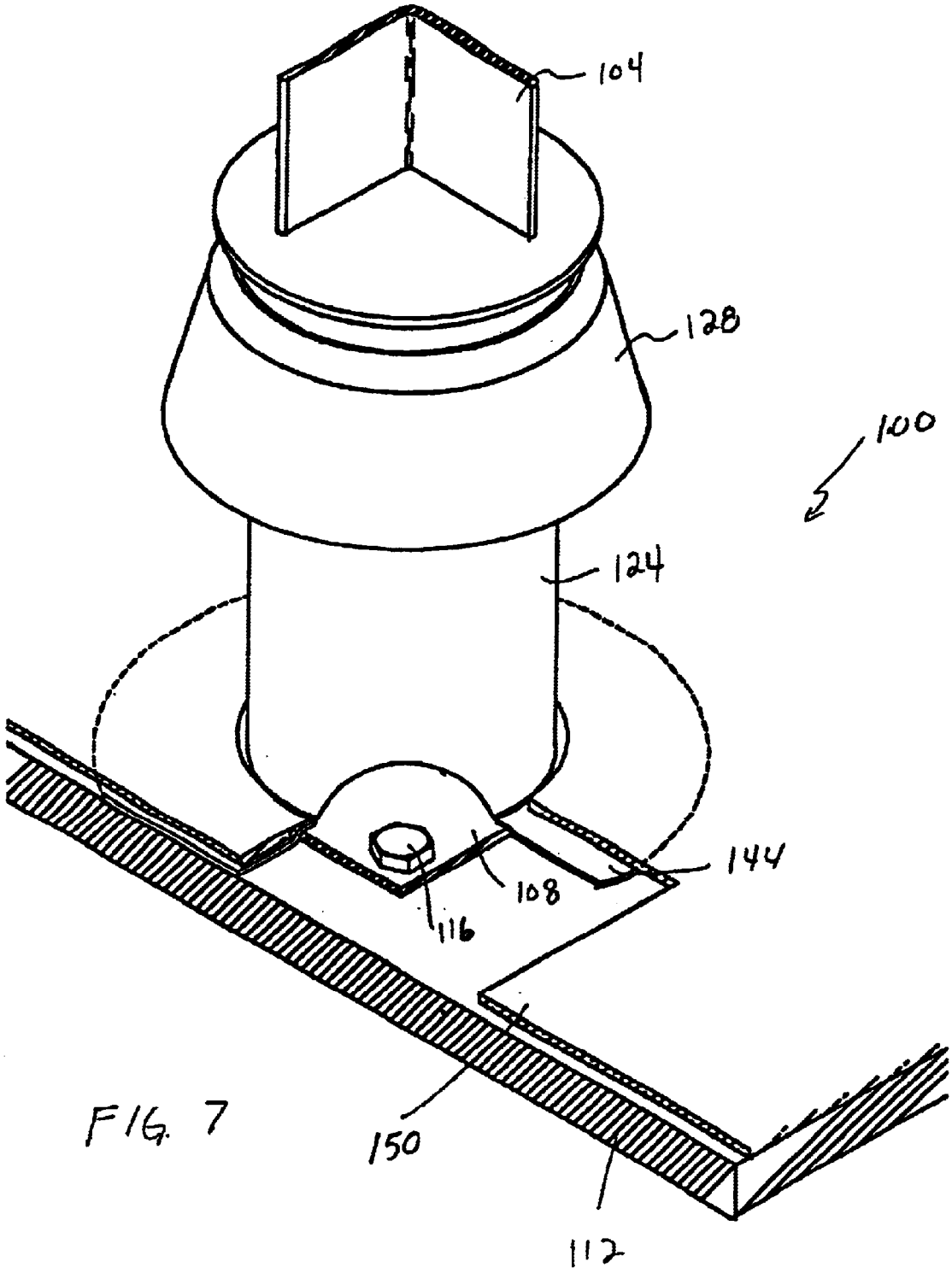
FIG. 7 is a perspective, partially cut-away view of the construction of FIG. 3, but without the hose clamp for illustrative purposes.

Next, the roofing contractor installs roofing plies (typically three plies) over the entire building. He nails with nails 140 (FIG. 6) the flange 144 of the lead pipe jack 124 through the ply layers and into the roof deck 112. The lead pipe jack 124 will typically have a three or four inch diameter and a four pound lead thickness. Instead of a lead jack, a cheaper standard galvanized steel roof jack can be used. Roofing plies 150 are stripped over the flange 144 thereby laminating the flange into the roof system. The finish layer of roofing materials (such as gravel or granule roll roofing) are installed over the ply layers.

Figure 5:
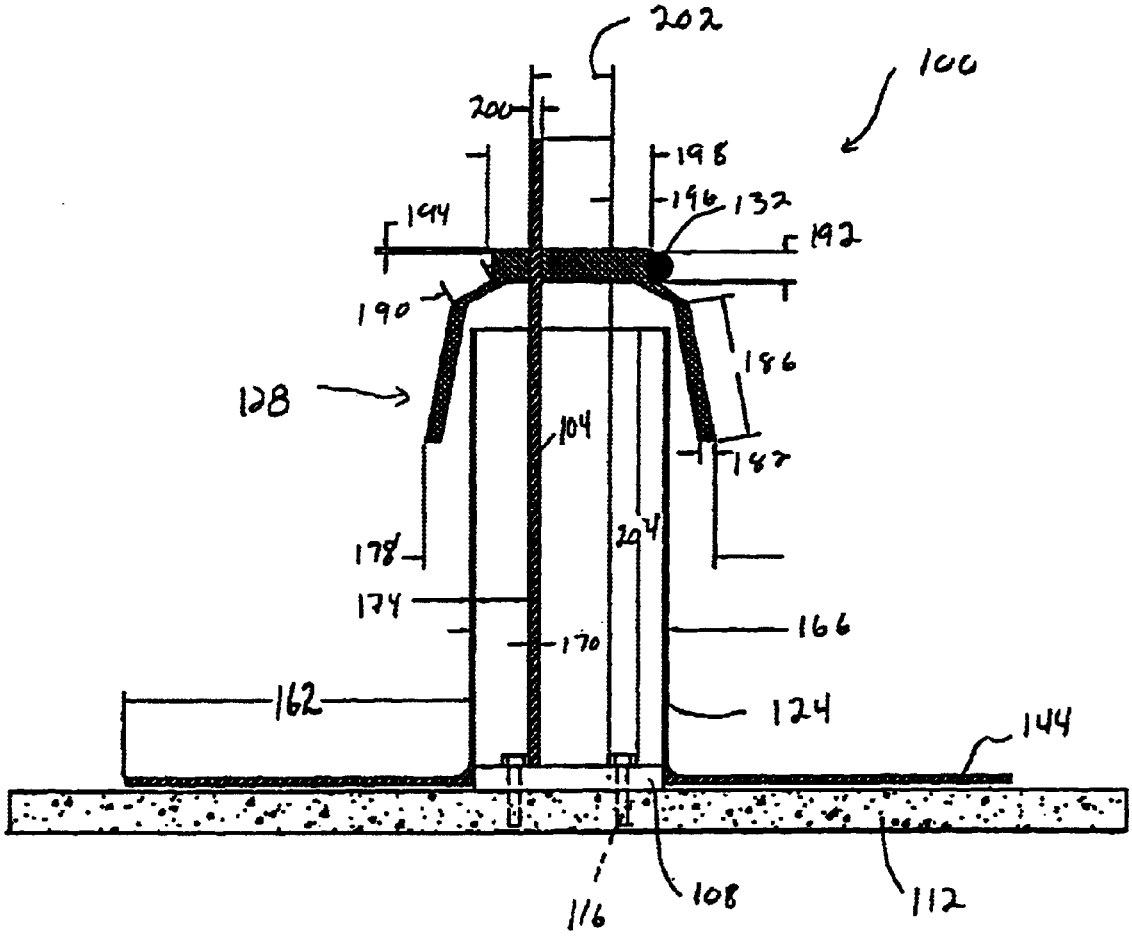
FIG. 5 is a reduced cross-sectional view taken on line 5—5 of FIG. 4.

The roofing contractor then slides the waterproofing assembly 128 over the leak flashing with its cone shape facing down. The stainless steel hose clamp 132 is placed in position on the waterproofing assembly and the clamp 158 tightened down. FIG. 5 shows dimensions 162, 166, 170, 174, 178, 182, 186, 190, 192, 194, 196, 198, 200, 202, 204 of 6.27, 3.64, 0.20, 0.07, 5.27, 0.25, 2.54, 0.80, 0.53, 0.07, 0.75, 3.04, 0.20, 1.50, and 7.87 inches, respectively. These are just sample dimensions, however, and it is within the scope of the invention to change dimensions, style, materials and heights above the roof deck as would be apparent to those skilled in the art.

Figures 9, 10, 11:
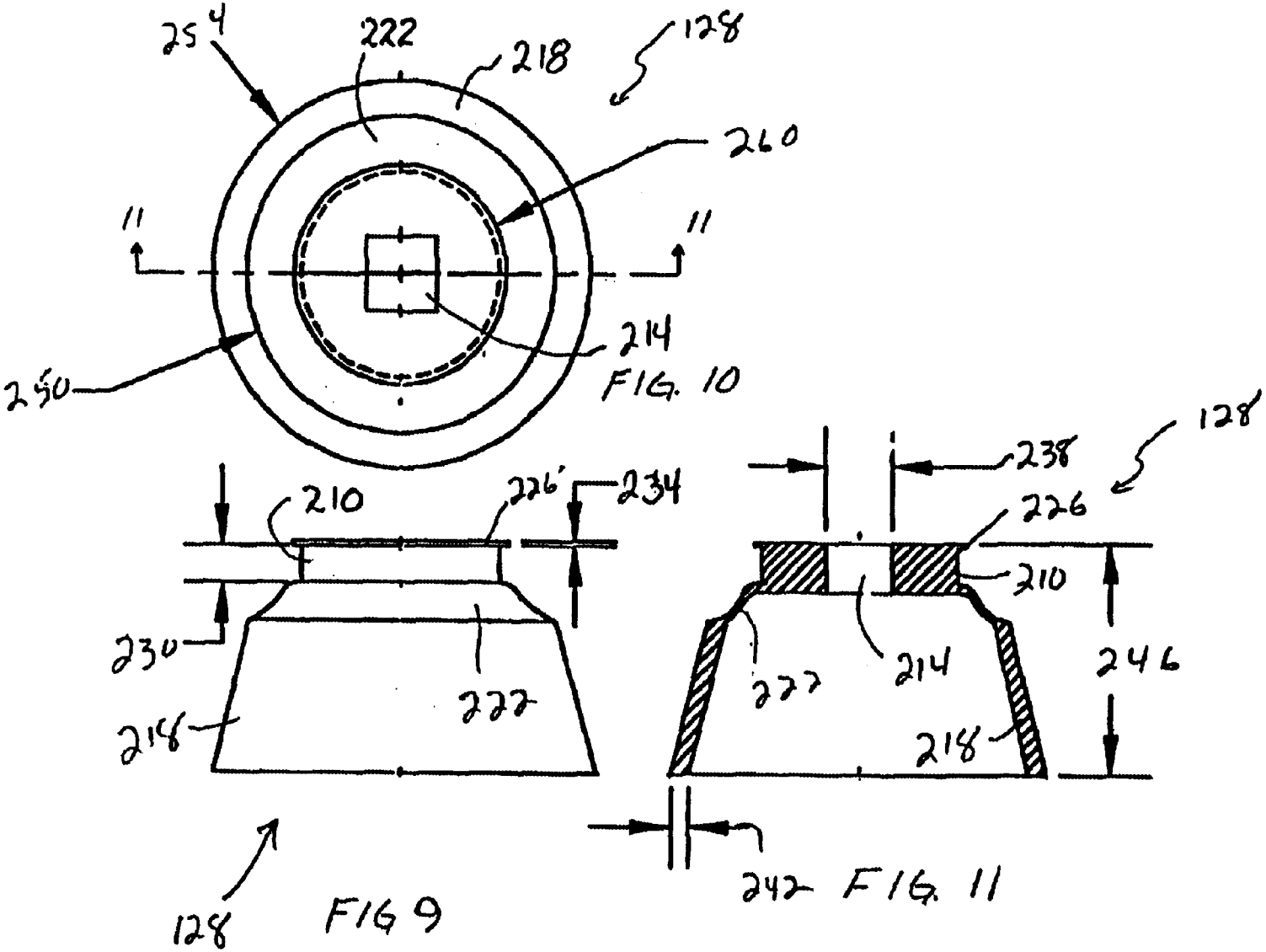
FIG. 9 is a side elevational view of an alternative waterproofing assembly of the present invention usable in the construction of FIG. 3, for example.
FIG. 10 is a top plan view of the unit of FIG. 9.
FIG. 11 is a cross-sectional view taken on line 11—11 of FIG. 10.

The waterproofing assembly 128 is shown in isolation in FIGS. 9, 10 and 11. It is seen therein that it has a collar portion 210 having an opening 214 therethrough, a downwardly-depending skirt 218, a shoulder 222 connecting the collar with the skirt, and a top rim or flange 226. These components according to one embodiment of this invention are integrally formed of EPDM molded rubber in a thermal process. This elastomeric construction allows the collar portion 210 to be squeezed by the hose clamp 132 to secure in a watertight manner the collar to the post 104, preventing water from leaking between the opening and the post. Sample dimensions 230, 234, 238, 242, 246, 250, 254 and 260, 0.51, 0.06, 1.00, 0.25, 3.11, R2.15, R2.63 and R1.50 inches, respectively, are shown in these figures.

Figures 8A, 8B, 8C:
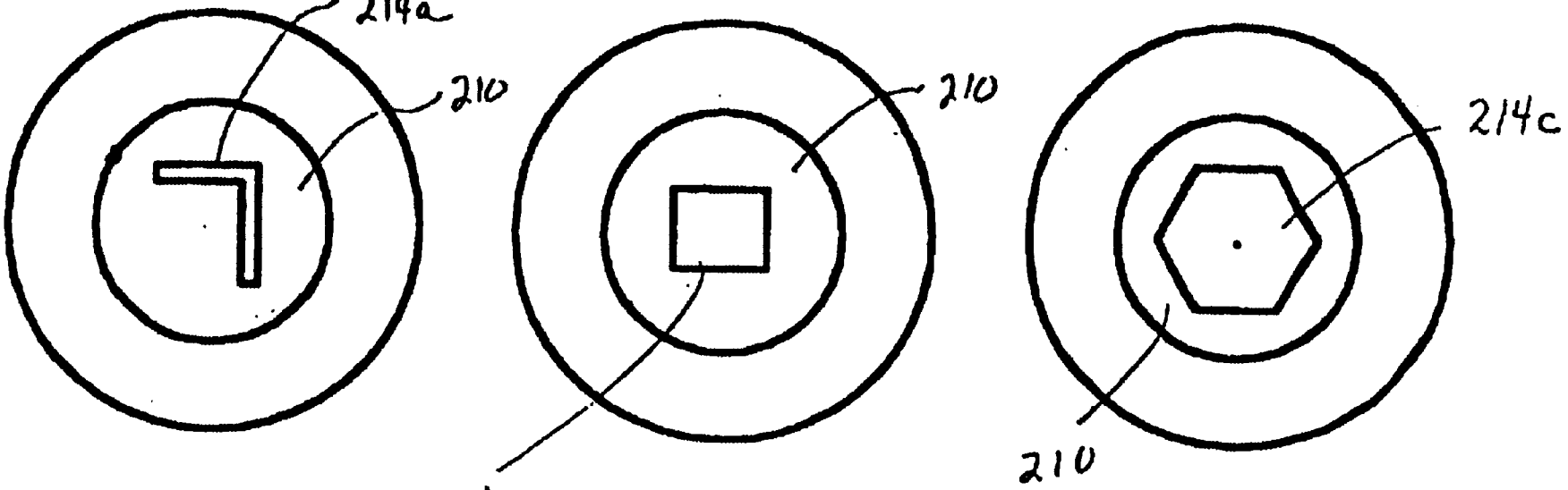
FIG. 8*a* is a top plan view of the waterproofing assembly of the construction of FIG. 7.
FIGS. 8*b* and 8*c* are first and second alternative designs, respectively, of the unit of FIG. 8*a* to accommodate posts of different corresponding cross-section configurations.

The opening 214 will be configured to have the same shape as the cross-section of the post (brace) 104 to which it is to be attached. Common shapes for the openings 214 are illustrated in FIGS. 8*a*, 8*b* and 8*c* as L shaped, square and hexagonal, respectively, at 214*a*, 214*b* and 214*c*.

Figure 16:
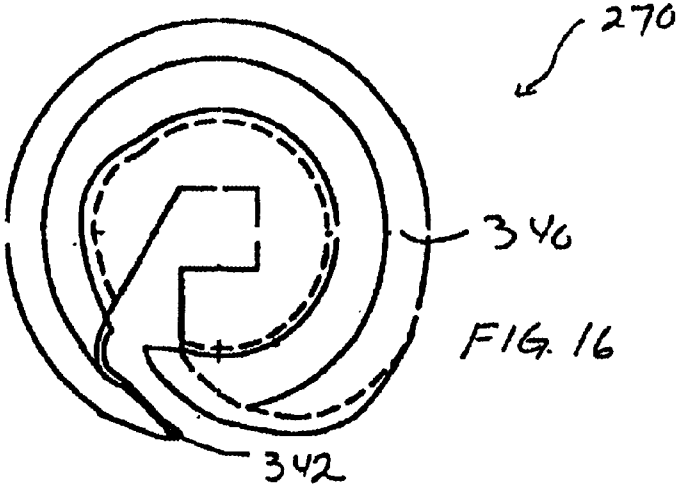
FIG. 16 is a view similar to FIG. 15 illustrating the unit in an open position.
Figure 15:
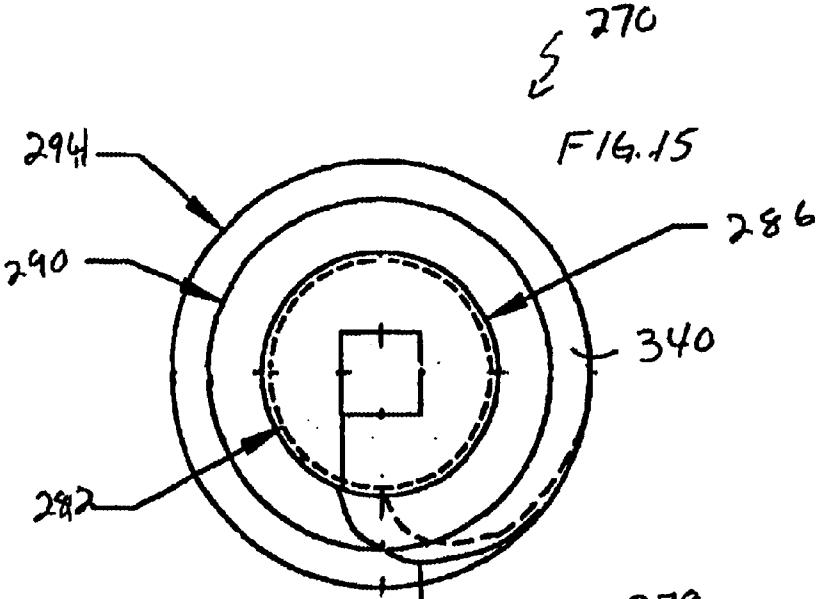
FIG. 15 is a top elevational view of the unit of FIG. 14.
Figure 14:
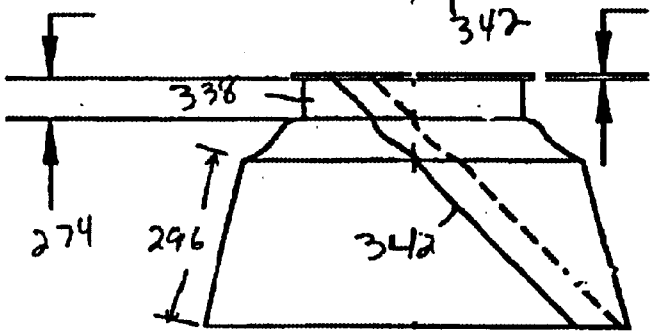
FIG. 14 is a view similar to FIG. 9 illustrating an open seam waterproofing assembly of the present invention.
Figure 24:
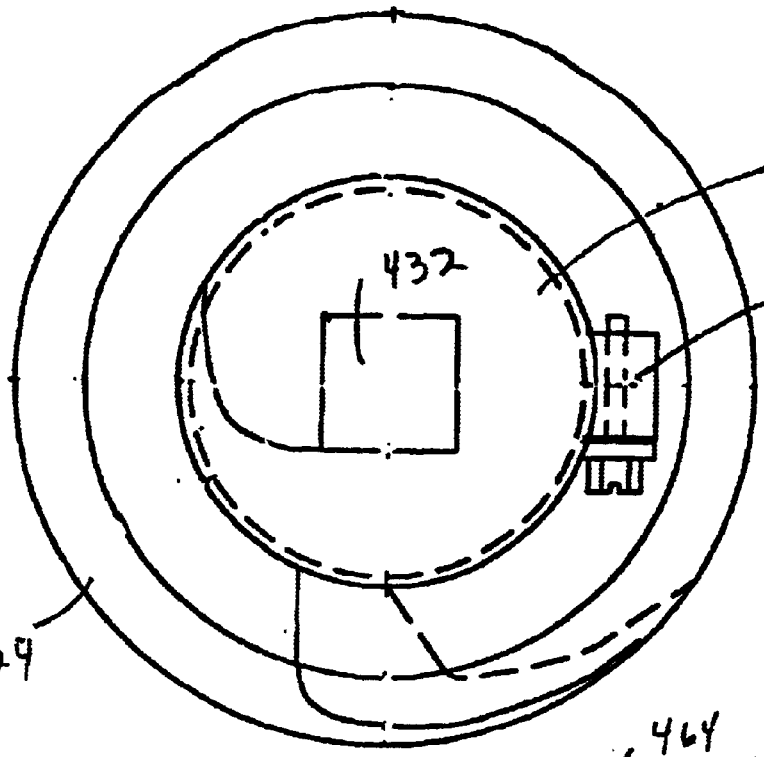
FIG. 24 is a top plan view of the unit of FIG. 23 with the hose clamps.
Figure 27:
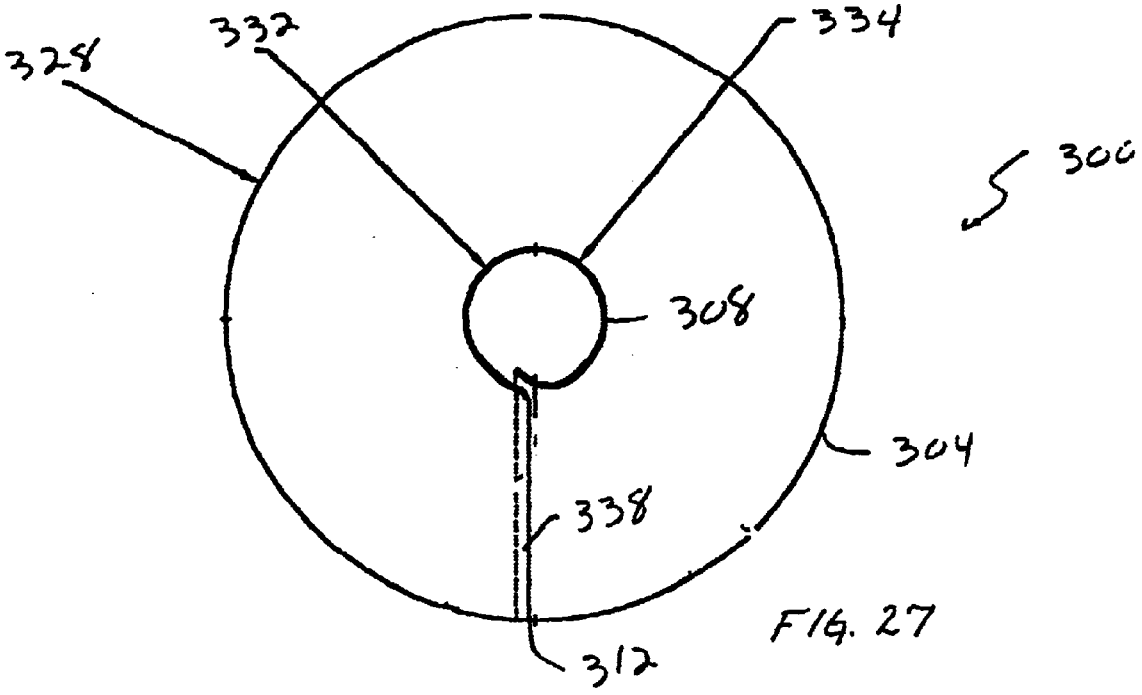
FIG. 27 is a top plan view of the split lead pipe jack of FIG. 26.
Figure 26:
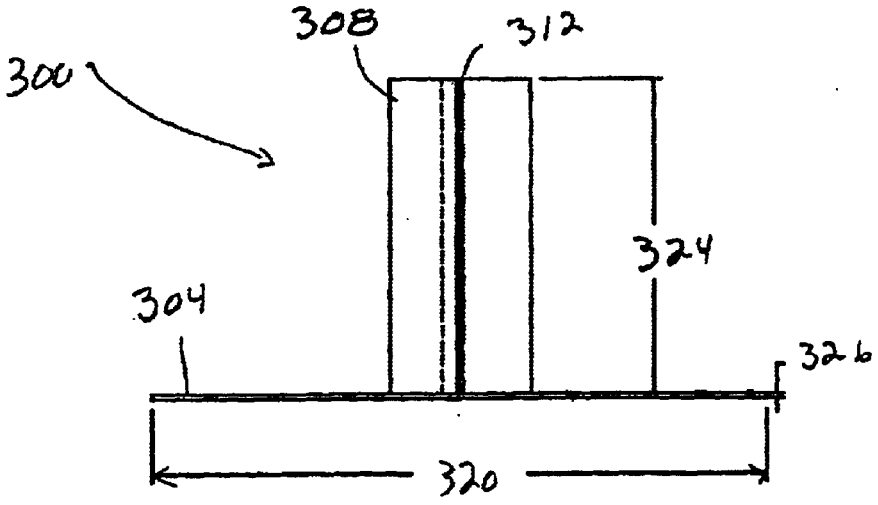
FIG. 26 is a side elevational view of a split lead pipe jack usable with the waterproofing assemblies of FIGS. 14, 18 and 23, for example, in a waterproof roof deck construction like that of FIG. 3.

If a post 104 (angle iron or other shaped brace) is already on a building and the waterproofing assembly 128 cannot be slid into position, a retrofit waterproofing assembly of this invention can be used as depicted in FIGS. 14–16 generally at 270. It has sample dimensions 274, 278, 282, 286, 290, 294 and 296 of 0.51, 0.06, R1.38, R1.50, R2.15, R2.63 and 2.10 inches, respectively. It is used together with a split lead flashing jack (which is a commercially available product) as illustrated generally at 300 in FIGS. 26 and 27. As shown in FIGS. 26 and 27, the split lead flashing jack 300 has a bottom flange 304 at the bottom of the sleeve 308, and an open seam 312 extends all of the way down the side. The split lead jack 300 can be a standard jack which is cut at the site to allow installation or it can be a special pre-cut jack. The split lead jack 300 has sample dimensions 320, 324, 326, 328, 332 and 334 of 15.50, 8.00, .125, R7.750 and R1.750, R1.813 inches, respectively.

The lead jack 300 is pulled open and wrapped around the existing support post (104). The lead metal of the jack 300 is soft enough to allow the jack to be opened and closed without using a separate hinge. The open seam 312 is then silver soldered closed with a propane torch. Lead material 338 overlaps to facilitate soldering.

Similar to construction 100, the roofing contractor installs his ply sheets and the flange 304 of the lead jack 300 is nailed through the ply sheets to the roof deck. Extra ply sheets are stripped over the flange to laminate it into the roof systems. The finish layer of roofing materials are installed onto the roof plies.

Figure 17:
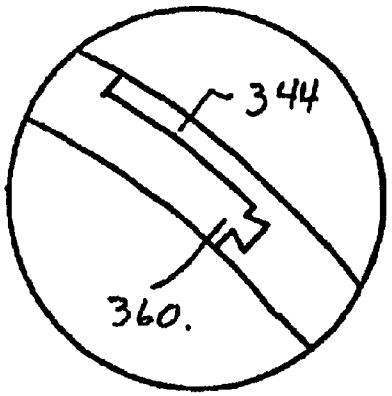
FIG. 17 is an enlarged view illustrating a portion of the seam of FIG. 14.

The retrofit collar 338 and skirt 340 of retrofit waterproofing assembly 270 is opened on its seam 342 and fit around the support post (104). With the assembly in place, the slip joint 344 on the collar 338 and skirt 340 is slid or snapped into place. The watertight flap 360 will be positioned facing downward, as shown in FIG. 17. A stainless steel hose clamp (132) is then positioned on the collar and clamped tight.

Figure 13:
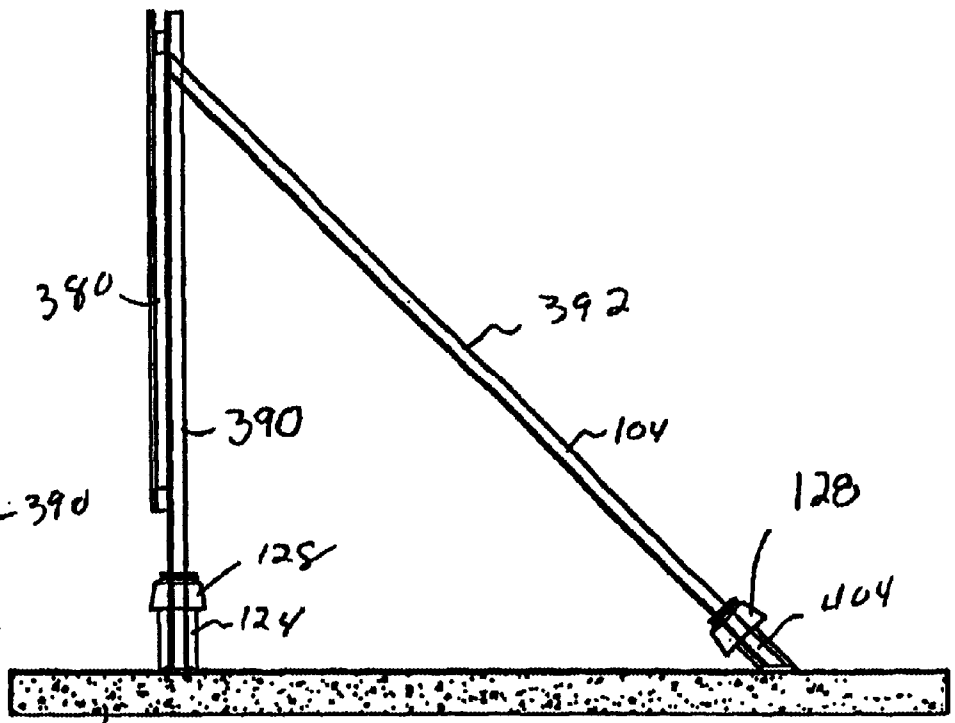
FIG. 13 is a side elevational view of the assembly of FIG. 12.
Figure 12:
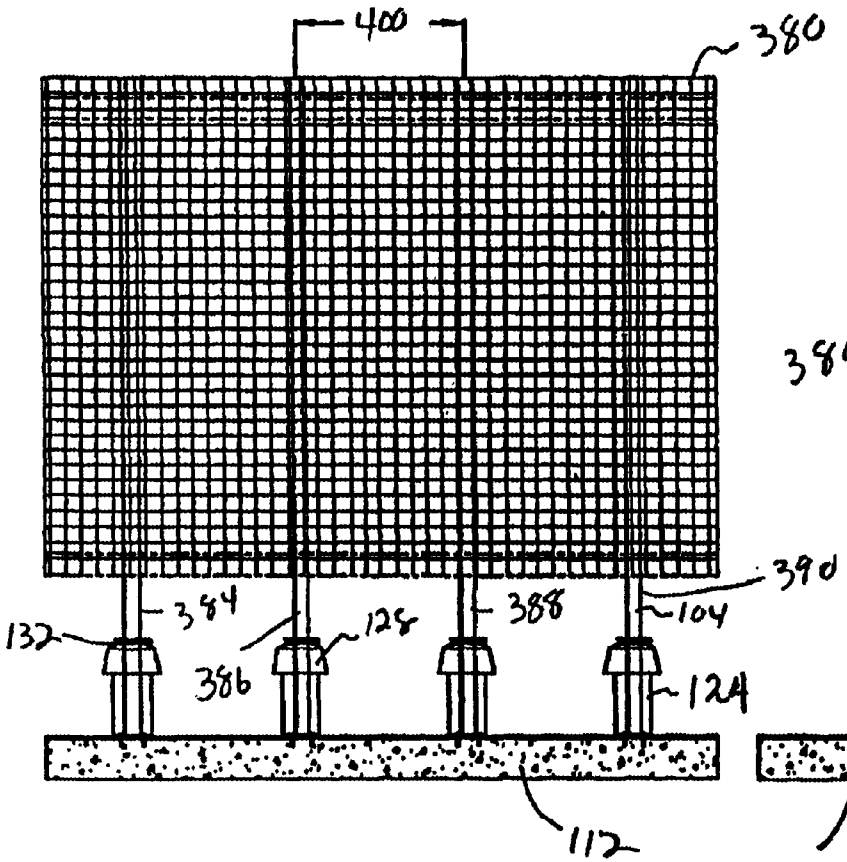
FIG. 12 is a side elevational view of a construction assembly of the present invention used to support rooftop fencing or screening structure.

The support post construction (100) of this invention using either waterproofing assembly 128 or retrofit waterproofing assembly 270 can be used to support generally any rooftop construction as is done today. An example is to support fencing or an equipment screen, as shown in FIGS. 12 and 13 generally at 380. Roof-mounted equipment fences or screens are often used at the perimeters of buildings to hide roof mounted machinery from ground view. The design as shown uses four front upright posts 384, 386, 388, 390 and four angled constructions 392 of this invention. The four front upright posts 384, 386, 388, 390 are mounted about sixteen inches apart as shown by dimension 400. The angled (angle iron brace) constructions 392 are at a forty-five degree angle and are welded at their tops to the upright constructions. They have a forty-five degree lead jack 404 and use the same waterproofing assemblies 128 or 270 as discussed above.

Figure 25:
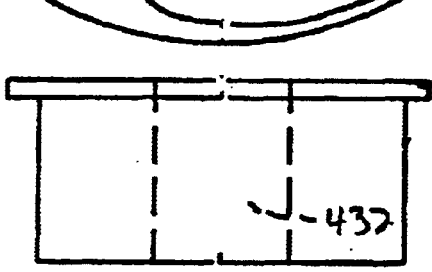
FIG. 25 is a side elevational view of the plug of the unit of FIG. 23 illustrated in isolation.
Figure 23:
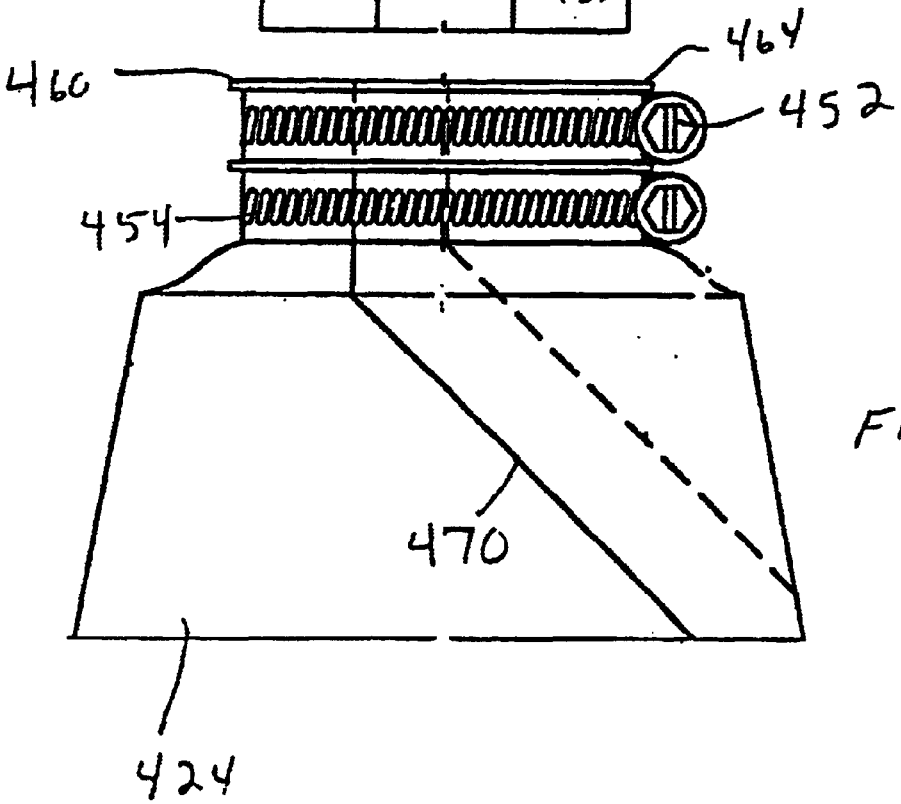
FIG. 23 is a side elevational view of another alternative waterproofing assembly of the present invention similar to that of FIG. 18 but with a detachable plug configured to accommodate two hose clamps as shown.

The collar portion of the waterproofing assembly can be formed as a separate unit from the skirt portion as shown in FIGS. 18–21 by waterproofing assembly 420. This can be for the standard or for the open-seam wrap around embodiments. This has the advantage that a single skirt portion 424 can be used for all types and shapes of support posts (104), and it is only the collar portion 428 with its different shapes of openings 432 (see FIGS. 8*a*, 8*b* and 8*c*) which varies. The separate collar 428 then acts like a plug to fit into the opening 436 at the top of the skirt 424 when pulled open as shown in FIG. 21. The collar 428 has a parting line 438 which opens to allow for installation. The slip joint 440 and watertight flap 442 are illustrated in the enlarged view of FIG. 22. Preferred dimensions 444, 446, 448, 450 are 0.51, 0.06, R1.38 and R1.48 inches, respectively. The (stainless steel) hose clamp (132) compresses and secures the plug 428 in place relative to the skirt 424 and the post (104). If needed, two clamps can be used, one above the other, as shown in FIG. 23 by hose clamps 452, 454. The two clamp embodiment will likely require a longer or taller collar (plug) 460 as depicted in FIG. 25.

The rim or flange 464 on the plug 460 allows for a positive stopping point when installing it into the construction. Also, it is a good waterproofing technique to let water that is flowing off the top of the plug 460 pass over the seam 470 of the collar and not into the seam. The flange 464 will overlap to the outside of the base of the collar.

Figure 30:
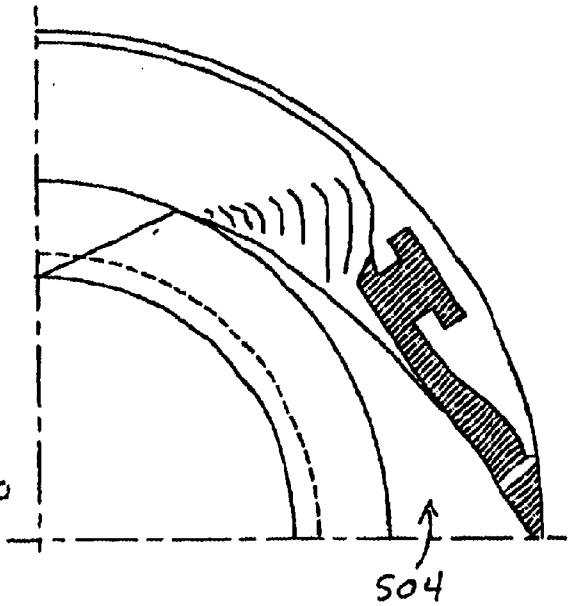
FIG. 30 is an enlarged, sectional bottom view of the slip joint of the assembly of FIG. 22.
Figure 28:
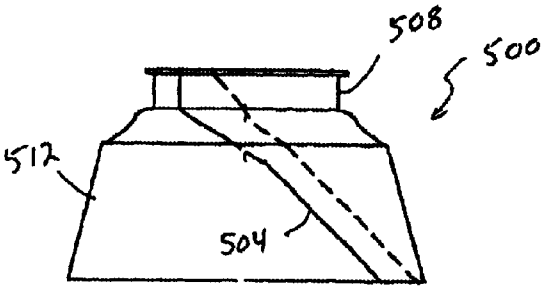
FIG. 28 is a view similar to FIG. 14 of an alternative assembly.
Figure 29:
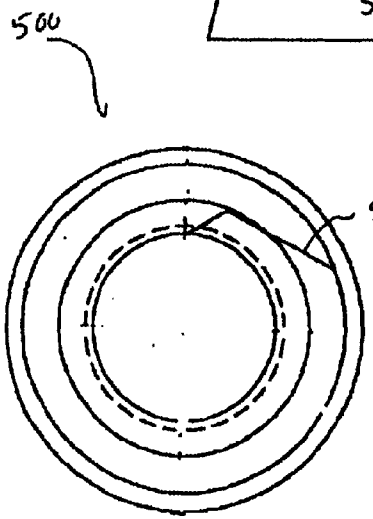
FIG. 29 is a bottom plan view of the assembly of FIG. 28.

FIGS. 28 and 29 show generally at 500 an alternative retrofit waterproofing assembly of this invention. It includes a slip joint 504 on the collar 508 and skirt 512. FIG. 30 is an enlarged view of the upper right portion of FIG. 29 showing in greater detail the slip joint 504 which allows the collar 508 to open.

Figure 31:
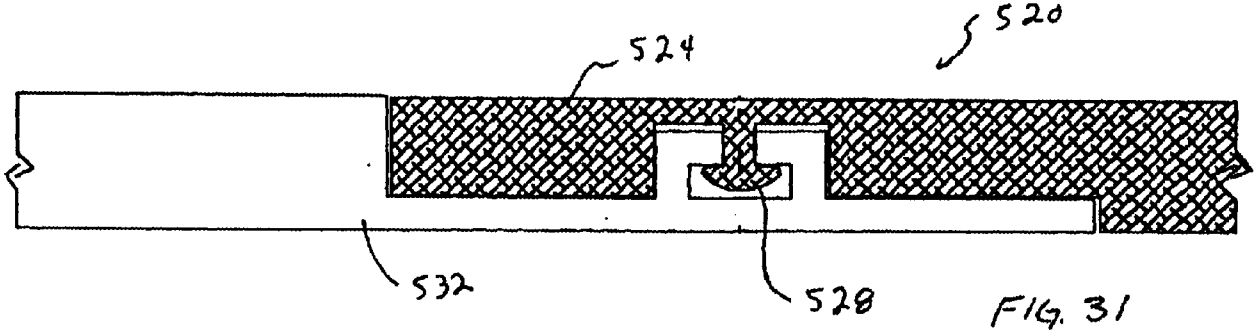
FIG. 31 is cross-sectional view of the snap-in slip joint.

Referring now to FIG. 31, an assembled EPDM rubber snap joint with flap is illustrated generally at 520 with the male insert 524 snapped with snap 528 into the female adapter 532. It functions generally similar to a ZIP LOCK bag. Unlike a typical plastic ZIP LOCK bag, the present assembly is made of rubber and its cross-section is different. Also, the snap and adapter areas are preferably made using a harder rubber than the rubber in the base collar. The collar is manufactured laying flat and then turned around to the point that the snap joint 520 can be pushed in by finger pressure. This is the only known roofing product that locks in place without tools.

Thus, the waterproof roof deck post constructions of this invention do not deform or shrink and thus prevent water from flowing into the roof penetration. Unlike the asphalt of the prior art Pitch Pocket, the waterproofing assembly will not crack over time requiring maintenance. The present constructions are also considerably cheaper and more attractive than the Pitch Pocket design. Additionally, the constructions of this invention are easier and quicker to install.

Figure 32:
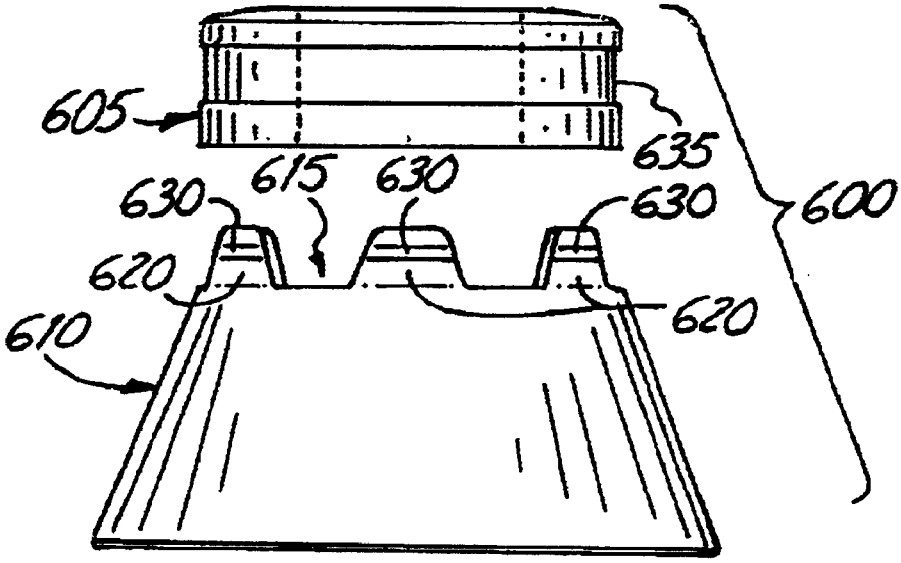
FIG. 32 is a side elevational view of an improved waterproofing assembly for use in a waterproof roof deck construction.
Figure 33:
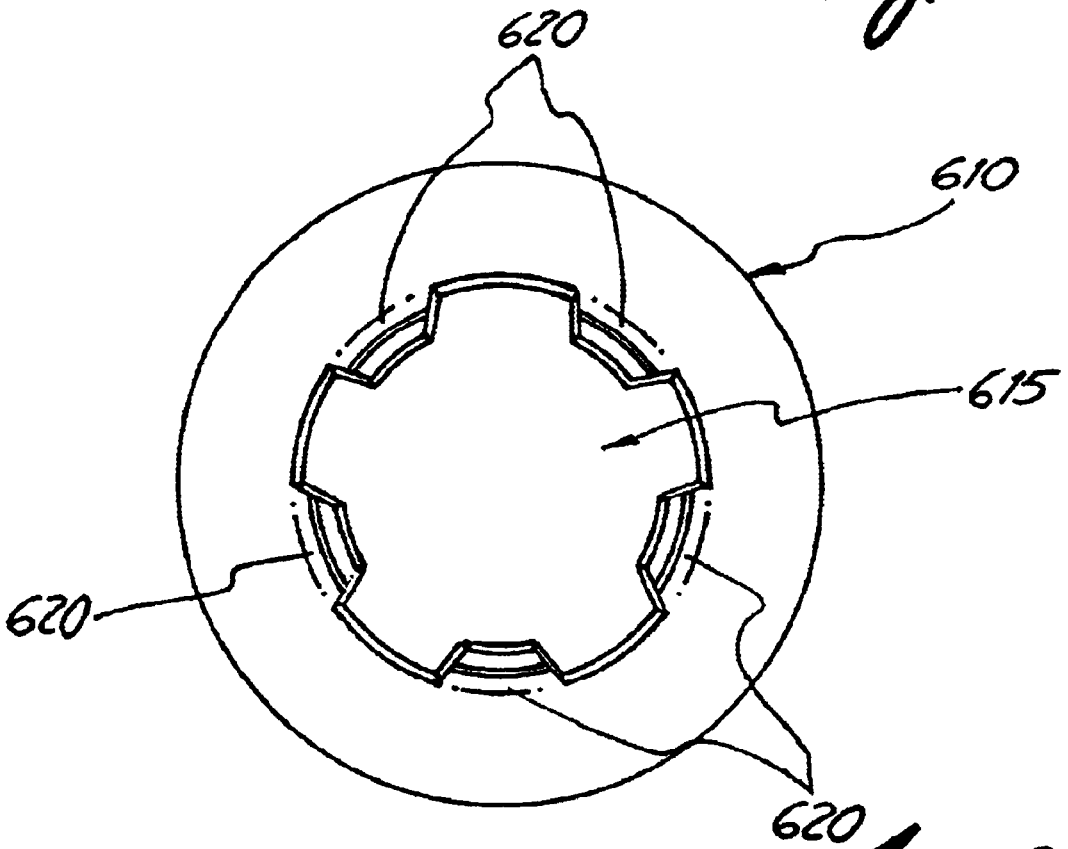
FIG. 33 is a top plan view of the skirt portion of the assembly of FIG. 32.
Figure 34:
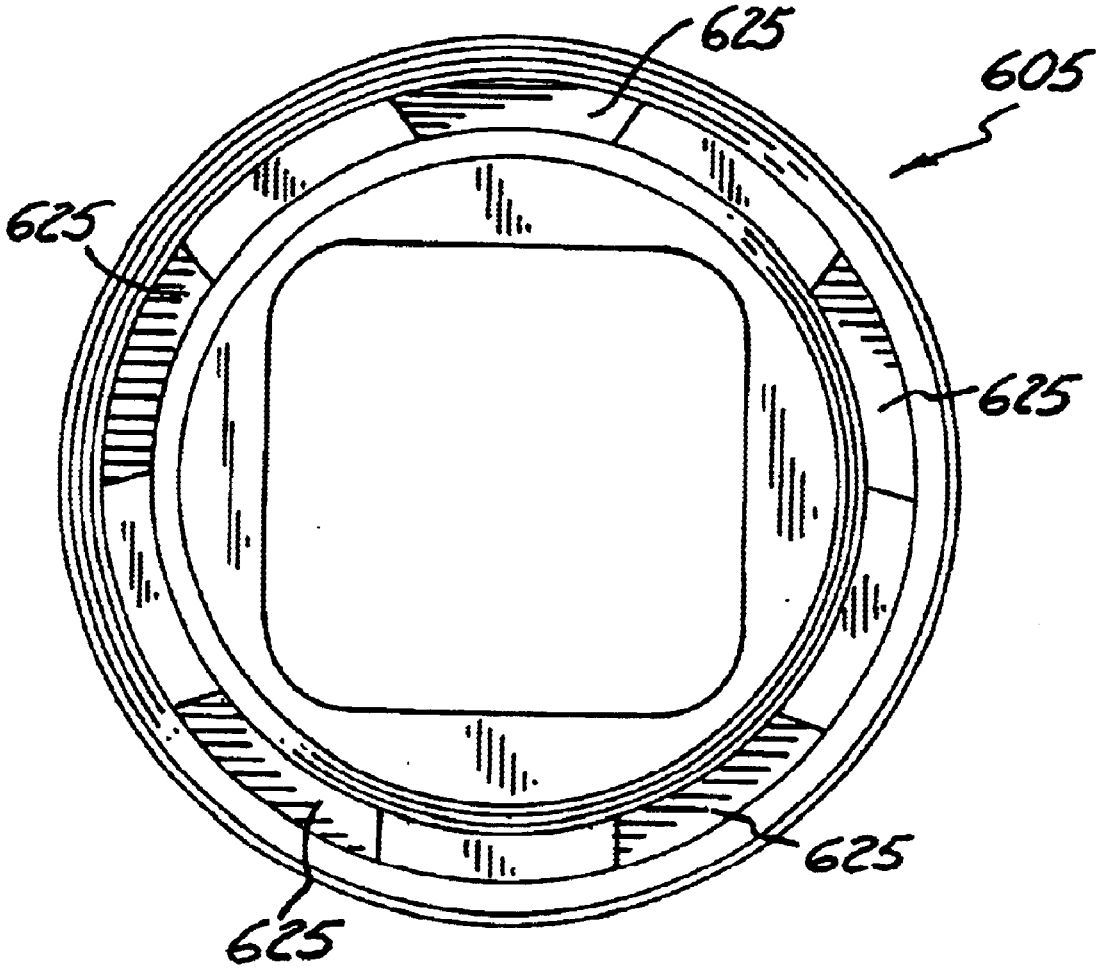
FIG. 34 is a bottom plan view of the collar plug portion of the assembly of FIG. 32.
Figure 42:
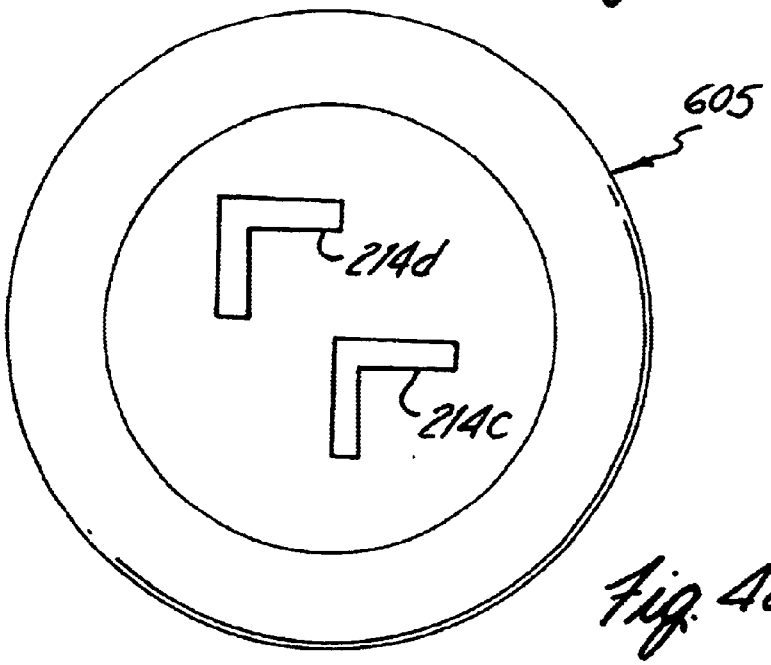
FIG. 42 is a top plan view of an alternative design for the waterproofing assembly that accommodates two posts.

Also described herein is a waterproofing assembly 600, which includes several improvements to the waterproofing assembly 128 and the retrofit waterproofing assembly 270 (or 420). Although an improved waterproof roof deck post construction is described herein, construction details, methods and alternatives as previously described for other embodiments may be incorporated herein for this embodiment as would be apparent to those skilled in the art. Referring to FIG. 32, as with waterproofing assembly 420, the collar 605 of the improved waterproofing assembly 600 can be formed as a separate unit from the skirt 610. Again, this has the advantage that a single skirt 610 can be used for all types and shapes of support deck posts (104). Only the collar 605 with its different shapes of openings (see FIGS. 8*a*, 8*b* and 8*c*) varies. The collar 605 acts like a plug by fitting into the skirt opening 615. The collar 605 can also be constructed to accept more than one support deck post. For example, FIG. 42 shows a collar 605 with openings 214*d* and 214*e* to accept two L-shaped deck posts. The collar 605 and the skirt 610 can be formed of E.P.D.M. (Ethylene Propylene Diene Terpolymer) rubber.

In the improved waterproofing assembly 600, the collar 605 connects to skirt 610 by inserting a series of flanged tabs 620 located on the top circumferential shoulder of the skirt 610. In one embodiment, there are five flanged tabs. Other embodiments have more or fewer flanged tabs 620. The flanged tabs 620 allow the skirt 610 to wrap around a full three hundred and sixty degrees without distortion. In the previous waterproofing assemblies, which lacked the flanged tabs, there is a possibility that the skirt may distort and not bend well. The flanged tabs 620 minimize this problem.

To further improve the connection of the skirt 610 to collar 605, the collar may be provided with a series of tab-receiving cavities 625. In such an assembly, the flanged tabs 620 are inserted each into a tab-receiving cavity 625 to connect collar 605 with skirt 610. In another embodiment, the flanged tabs 610 may each also be provided with a projection 630. The flanged tabs 610 are inserted into the tab-receiving cavities 625 past the point of the projections 630. The projections 630 increase the pull-out resistance of the collar 605 from the skirt 610, thereby improving the connection of the collar 605 to the skirt 610.

As a further improvement, collar 605 may be built with a clamping recess 635 molded around the circumference of the collar 605. The hose clamp (132) or other such band can be placed within the clamping recess 635 before it is tightened to secure the collar 605 and skirt 610 about the deck post (104).

Figure 35:
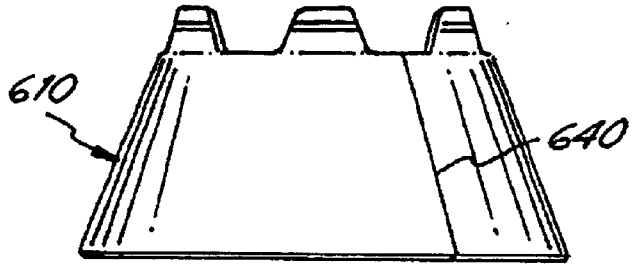
FIG. 35 is a side elevational view of an improved waterproofing assembly as shown in FIG. 32, but with a split joint for retrofitting the skirt.
Figure 36:
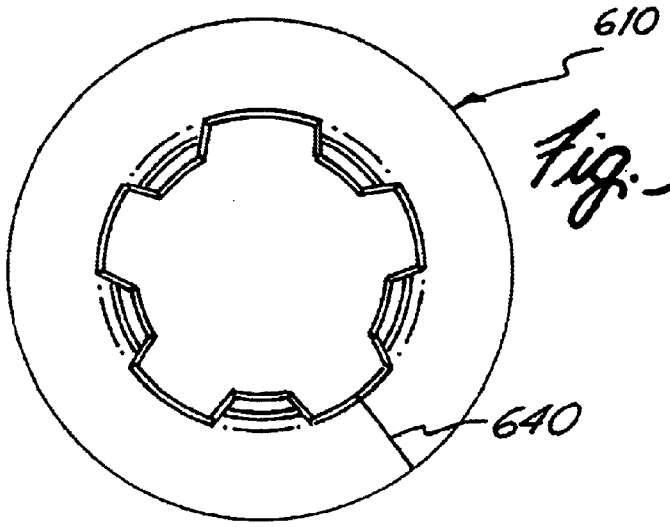
FIG. 36 is a top plan view of the skirt shown in FIG. 35.
Figure 37:
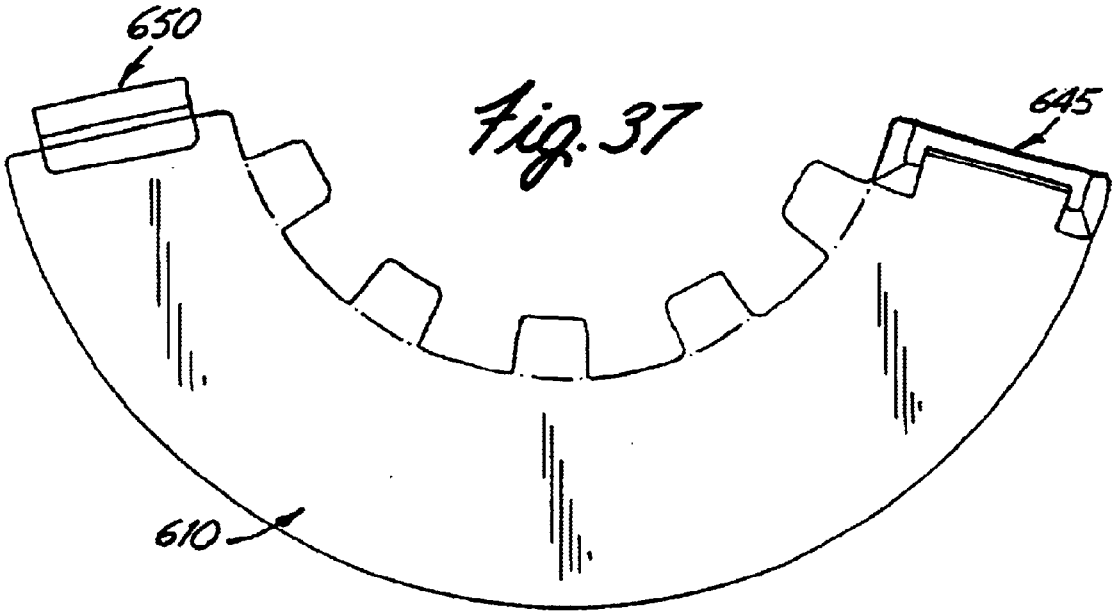
FIG. 37 is a top plan view of the skirt shown in FIG. 35, before the skirt is formed into its generally cylindrical shape by locking its clasp into its locking slot.
Figure 38:
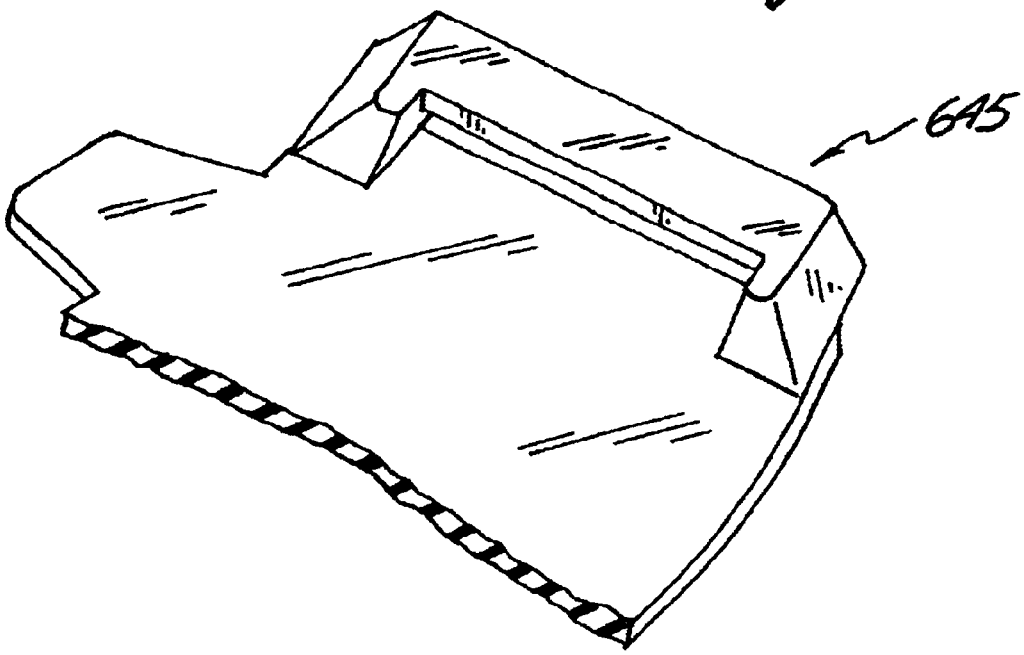
FIG. 38 is a detailed view of the locking slot of FIG. 37.
Figure 39:
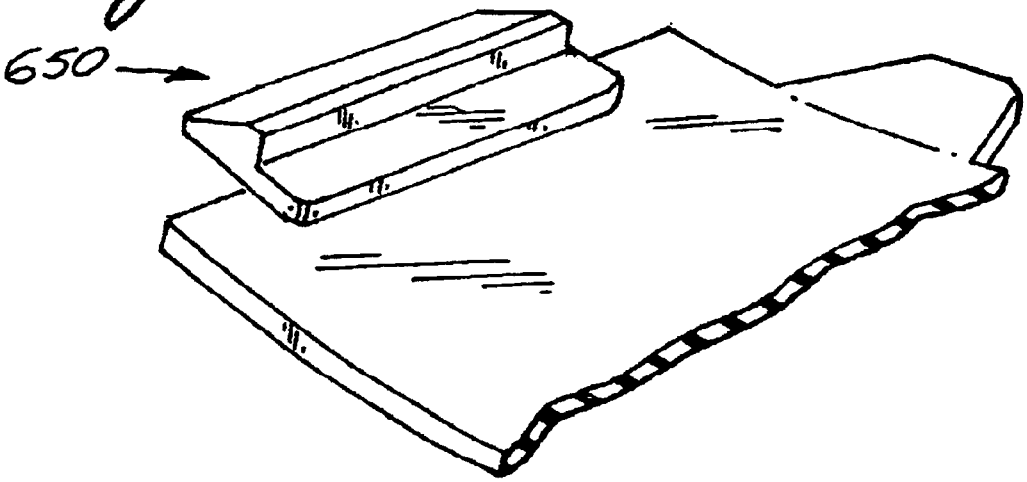
FIG. 39 is a detailed view of the clasp of FIG. 37.
Figure 40:
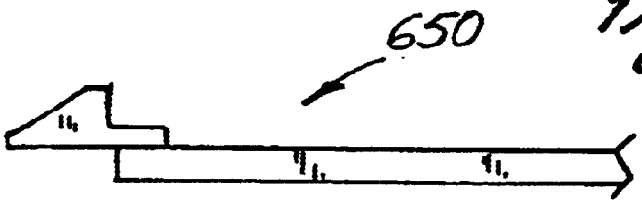
FIG. 40 is another detailed view of the clasp of FIG. 37.

In prior embodiments, the collar or skirt may have been created with a split joint so that the waterproofing assembly could be retrofitted around a deck post (see FIGS. 14-17). In the retrofitted assembly, the collar and the skirt have split joints so that they can 17). In the retrofitted assembly, the collar and the skirt have split joints so that they can be wrapped around the deck post and then secured closed. Another improvement to the waterproofing assembly in one embodiment is the use of an improved system to securely close the skirt. In FIGS. 35 and 36, there is a skirt 610 with a split joint 640. FIG. 37 shows the skirt 610 in its state prior to being wrapped around a deck post and secured close. The split joint is closed by inserting the clasp 650 into the locking slot 645. When locked, the split joint is generally waterproof. The clasp 650 and locking slot 645 may be designed in several configurations. One such configuration is to have the clasp 650 shaped as a rectangular wedge and the locking slot 645 designed so that the rectangular wedge is forced through the locking slot's rectangular hole, locking the split joint. FIGS. 38 through 40 show the clasp 650 and locking slot 645 in greater detail.

Figure 41:
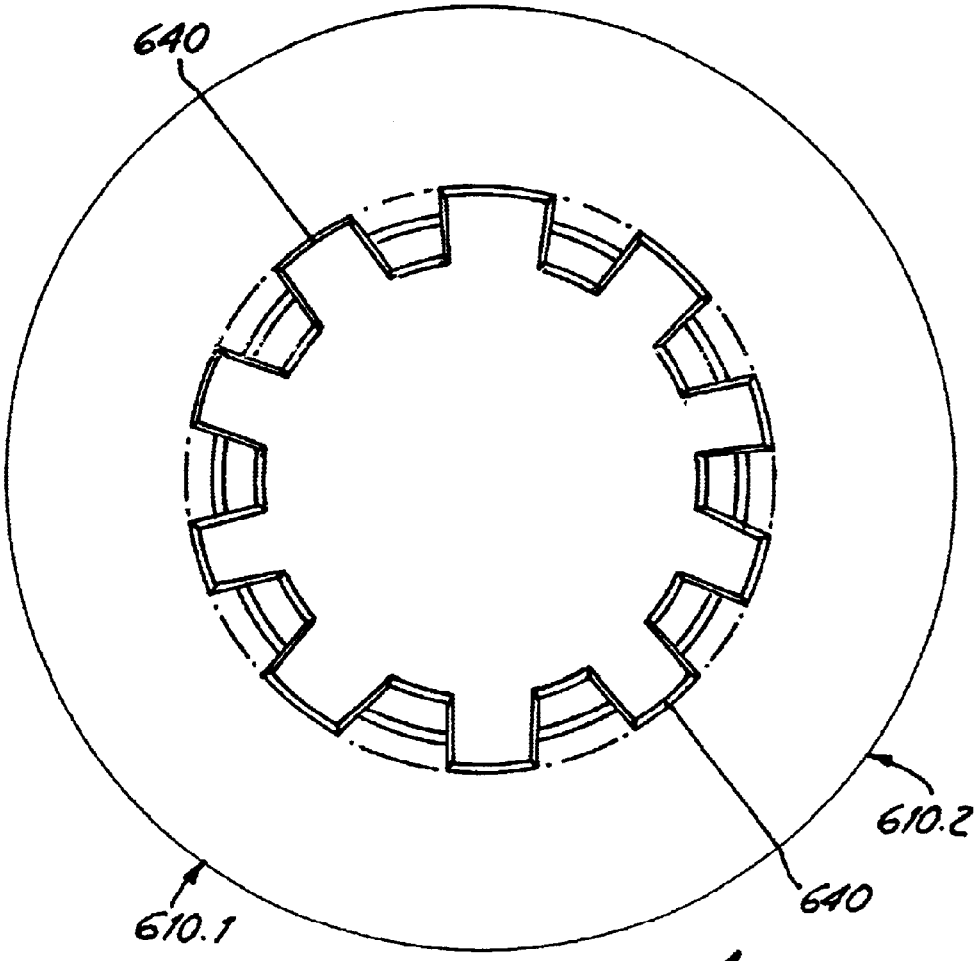
FIG. 41 is a top plan view of the skirt portion of FIG. 32 when the skirt is formed with a series of skirting pieces locked together.

The use of clasp 650 and locking slot 645 to close the split joint has another advantage, as can be understood from FIG. 41. In one embodiment, more than one skirt (referred to herein as 'skirting pieces') 610 can be connected together to form a larger overall skirt. In FIG. 41, two skirting pieces 610.1 and 610.2 are connected together to form a skirt. The clasp of skirting piece 610.1 has been forced into the locking slot of skirting piece 610.2 and the clasp of skirting piece 610.2 has been forced into the locking slot of skirting piece 610.1 so that the two skirting pieces form one skirt. By linking skirts together, one can increase the diameter of the skirt.

An advantage to this system is that different sizes of collars can be manufactured for use with smaller and larger deck posts. These various sized collars can all be assembled using just one size of skirt. For smaller collars, just one skirting piece is used to form the skirt. For larger collars, two or more skirting pieces are interconnected to form the skirt. For example, a small plug (perhaps with five tab-receiving cavities) may be used for waterproofing 2" by 2" metal deck posts using a single skirting piece for the skirt. A larger plug (perhaps equipped with ten tab-receiving cavities) may be manufactured for waterproofing 4" by 4" metal deck posts using two skirting pieces linked together as the skirt. Using this methodology, even larger plugs could be created to support more than two skirting pieces linked together.

In summary, disclosed herein are geometric collars created to waterproof various non-standard geometric shaped roof penetrations, such as fence posts, signs, and parapet wall supports. The construction of these collars are unique because they fit around existing roof penetrations by splitting apart, so that they can then wrap around roof penetrations, and locking onto them. This assembly creates a watertight umbrella, and watertight umbrellas are recommended in the roofing industry for counter flashing, standard flashings or roof jacks.

Figure 2:
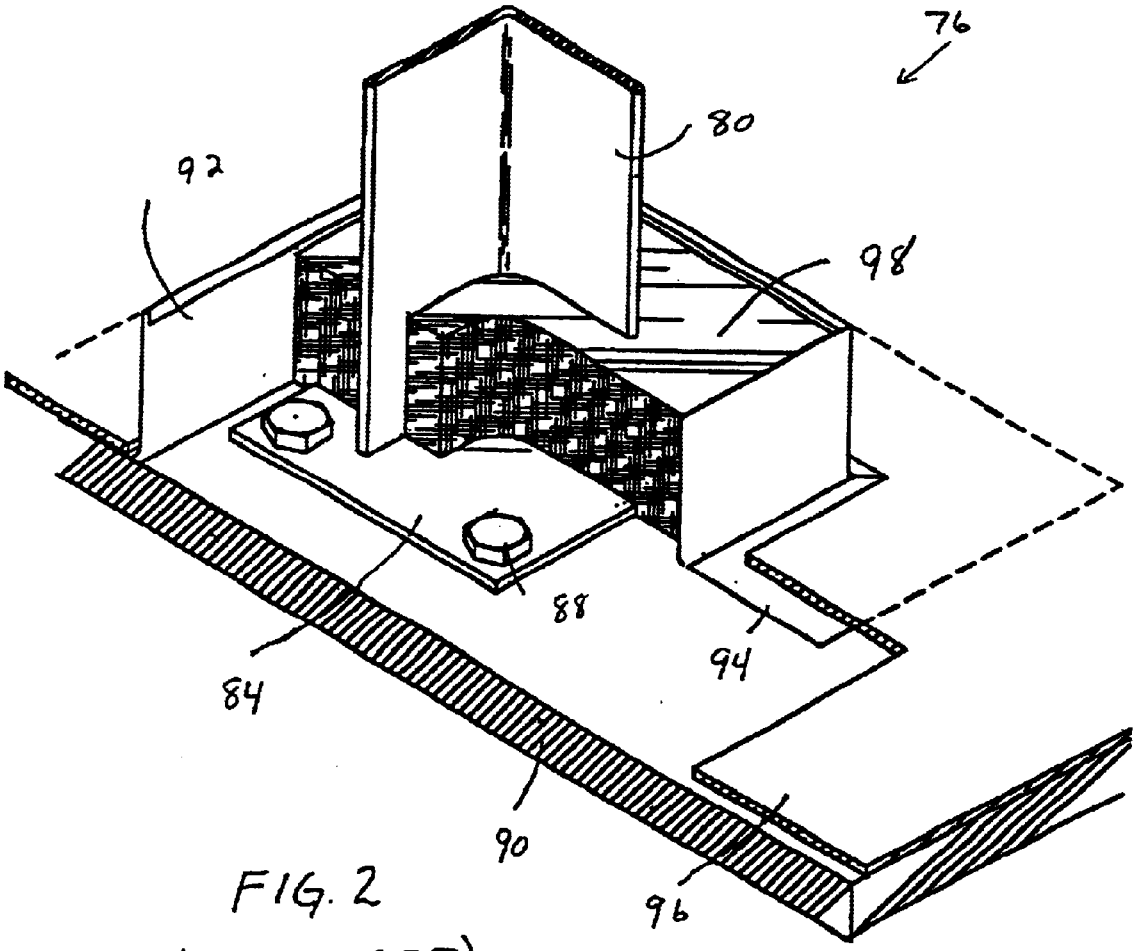
FIG. 2 (PRIOR ART)
FIG. 2 is a perspective cut-away view of an angle iron brace roof-mounted ("Pitch Pocket") construction of the prior art.
Figure 3:
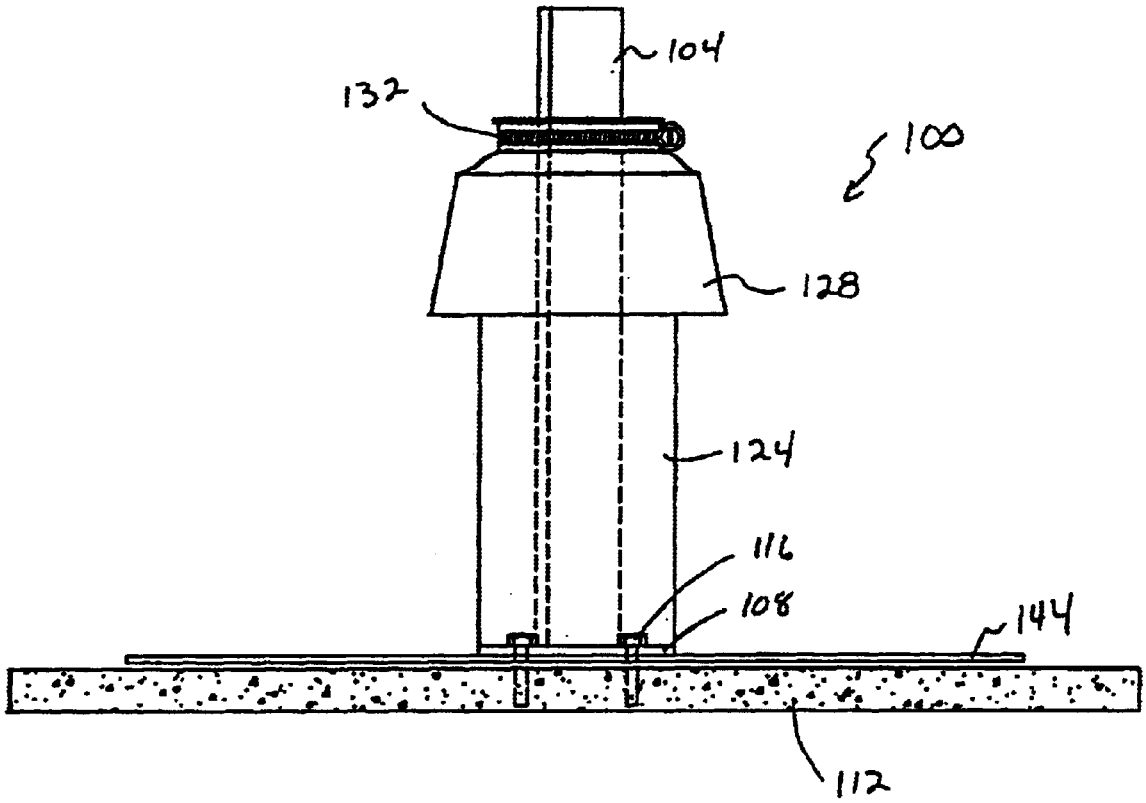
FIG. 3 is a side elevational view of a waterproof roof deck construction of the present invention.
Figure 4:
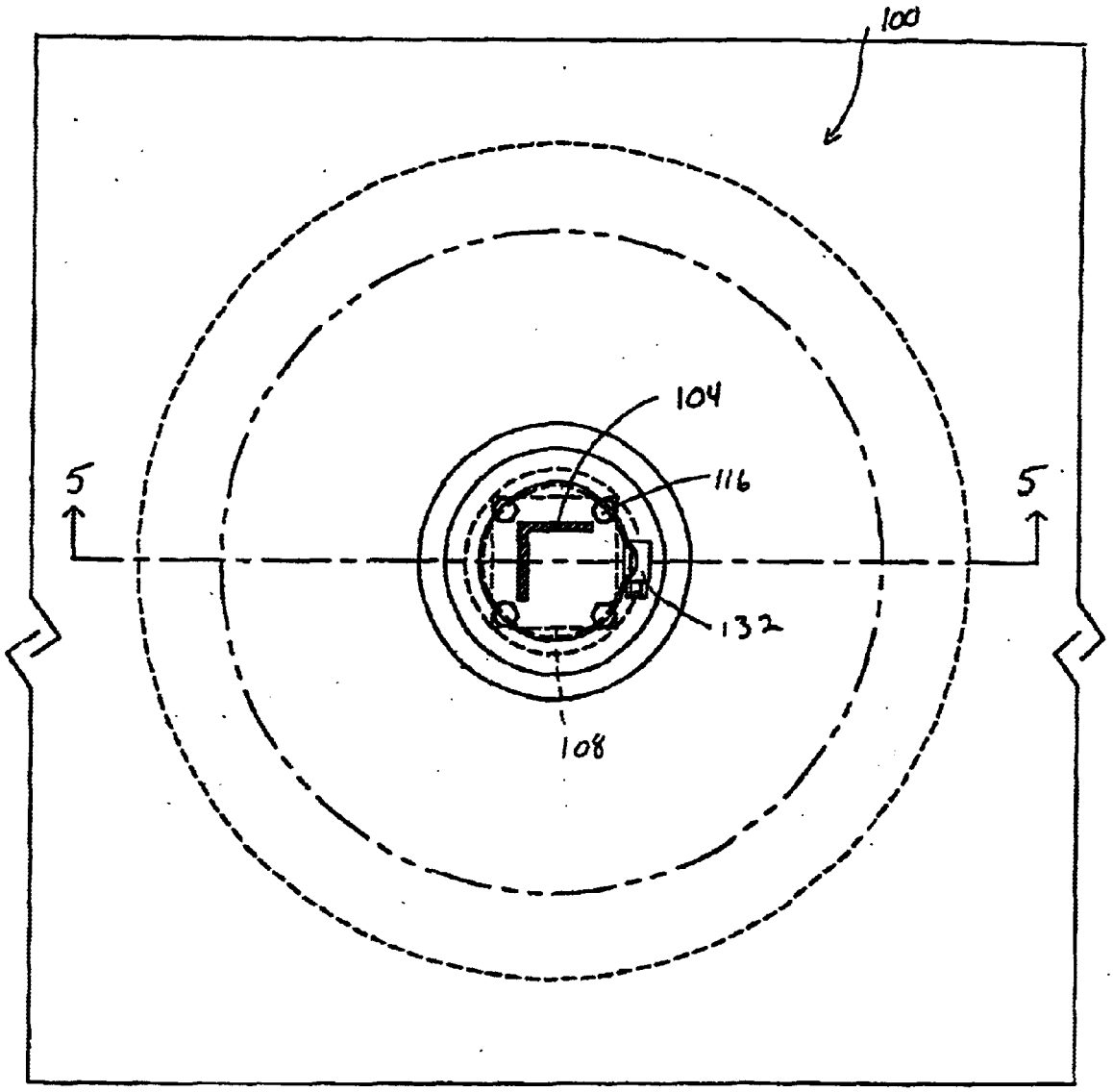
FIG. 4 is an enlarged top plan view of the construction of FIG. 3.

These geometric collars also fulfill N.R.C.A. (National Roofing Contractors Association) requirements. *The Handbook of Accepted Roofing Knowledge* (HARK) page 7, Section VIII., *Mechanical Curbs and Penetrations states*: "The use of so-called 'pitch boxes' or 'pitch pockets' around penetrations should be avoided because they pose a constant maintenance problem." The present geometric collars are a low cost method for eliminating Pitch Pockets, as shown in FIG. 2. By utilizing a two or three piece design the size of the collar can be expanded to accommodate many different roof penetration sizes. Also, the diameter of the umbrella cone can be expanded by attaching two skirts together and using a larger diameter geometric plug.

From the foregoing detailed description, it will be evident that there are a number of changes, adaptations and modifications of the present invention which come within the province of those skilled in the art. However, it is intended that all such variations not departing from the spirit of the invention be considered as within the scope thereof.

What is claimed is:

1. A waterproof roof deck post construction, comprising:

a deck post having a cross-section and secured relative to a roof deck;

a sleeve surrounding a lower portion of the deck post; and a waterproofing assembly including a collar and a skirt, the collar having an opening having generally the same cross-section as that of the deck post, the deck post being disposed in the opening, the collar formed as a plug, which is a separate piece from the skirt and adapted to be fitted into an opening in the skirt, the collar surrounding the deck post above a top of the sleeve, and the skirt extending down from the collar and out over the top of the sleeve;

wherein the skirt includes a circumferential shoulder having a plurality of flanged tabs for connecting the collar and the skirt.

2. The construction of claim 1 wherein the cross-section of the desk post is non-circular.

3. The construction of claim 1 wherein the collar is fitted with a series of tab-receiving cavities for accepting the plurality of flanged tabs.

4. The construction of claim 1 wherein the flanged tabs each include a projection for increasing the pull-out resistance between the connection of the collar and the skirt.

5. The construction of claim 1 further comprising a band surrounding the collar and securing in a generally watertight manner the collar to the deck post.

6. The construction of claim 5 wherein the collar includes a clamping recess for accepting the band surrounding the collar.

7. The construction of claim 1 wherein the skirt includes a split joint through the skirt, the split joint including a clasp and a locking slot, the locking slot fitted for the clasp, for closing the split joint in a generally watertight manner.

8. The construction of claim 7 wherein the clasp is a rectangular wedge.

9. The construction of claim 1 wherein the skirt includes a plurality of skirting pieces, the skirting pieces each having a split joint through the skirting piece, the split joint including a clasp and a locking slot, the locking slot fitted for the clasp, the skirting pieces interconnected in a generally watertight manner to form the skirt by locking the clasp of one skirting piece to the locking slot of an adjoining skirting piece.

10. The construction of claim 1 wherein the deck post defines a first deck post, and further comprising a second deck post having a cross-section and secured relative to a roof deck, and wherein the collar has an opening having generally the same cross-section as that of the second deck post.

11. A waterproofing assembly, comprising:

a collar for surrounding a deck post and being secured thereto in a generally watertight manner;

a skirt extending down from the collar and out over the deck post; and the collar being formed as a plug which is a separate piece from the skirt and is adapted to be fitted into an opening in the skirt;

wherein the skirt includes a circumferential shoulder having a plurality of flanged tabs for connecting the collar and the skirt.

12. The waterproofing assembly of claim 11 wherein the collar is fitted with a series of tab-receiving cavities for accepting the plurality of flanged tabs.

13. The waterproofing assembly of claim 11 wherein the plurality of flanged tabs each include a projection for increasing the pull-out resistance between the interconnection of the collar and the skirt.

14. The waterproofing assembly of claim 11 wherein the collar has an opening having generally the same non-circular cross-section as that of the deck post.

15. The waterproofing assembly of claim 11 further comprising a band surrounding the collar and securing the collar to the deck post in a generally watertight manner.

16. The waterproofing assembly of claim 15 wherein the collar includes a clamping recess for accepting the band surrounding the collar.

17. The waterproofing assembly of claim 11 wherein the skirt includes a split joint through the skirt, the split joint including a clasp and a locking slot, the locking slot fitted for the clasp for closing the split joint in a generally watertight manner.

18. The waterproofing assembly of claim 17 wherein the clasp is a rectangular wedge.

19. The waterproofing assembly of claim 11 wherein the skirt is made from a plurality of skirting pieces, the skirting pieces each having a split joint through the skirting piece, the split joint including a clasp and a locking slot, the locking slot fitted for the clasp, and the skirting pieces interconnected in a generally watertight manner to form the skirt by locking the clasp of one skirting piece to the locking slot of the adjoining skirting piece.

20. The waterproofing assembly of claim 11 wherein deck post defines a first deck post, and the collar further has a second opening having generally the same cross-section as that of a second deck post.

21. The waterproofing assembly of claim 11 wherein the deck post is a roof deck post.

22. A method of constructing a waterproof roof desk post construction, comprising:

(a) securing a deck post having a cross-section to a roof deck;

(b) securing a sleeve surrounding a lower portion of the deck post;

(c) providing a waterproofing assembly including a collar and a skirt, the collar having an opening having generally the same cross-section as that of the deck post; the collar formed as a plug which is a separate piece from the skirt and adapted to be fitted into an opening in the skirt; and (d) positioning the waterproofing assembly such that the deck post extends through the opening in the collar and the skirt extends down over a top of the sleeve;

wherein the providing a waterproofing assembly includes providing a circumferential shoulder on the skirt, the circumferential shoulder including a plurality of flanged tabs for connecting the collar and the skirt.

23. The method of claim 22 wherein the providing a waterproofing assembly includes fitting the collar with a series of tab-receiving cavities for accepting the plurality of flanged tabs.

24. The method of claim 22 wherein the providing a waterproofing assembly includes providing a projection on each of the plurality of flanged tabs, the projections increasing the pull-out resistance between the connection of the collar and the skirt.

25. The method of claim 22 further comprising applying a band around the collar to secure the collar in a generally watertight manner to the deck post.

26. The method of claim 25 wherein the applying a band around the collar includes applying the band within a clamping recess on the collar.

27. The method of claim 22 wherein the providing a waterproofing assembly includes providing a split joint through the skirt, the split joint including a clasp and a locking slot, the locking slot fitted for the clasp, for closing the split joint in a generally watertight manner.

28. The method of claim 27 wherein the providing a waterproofing assembly includes providing the clasp in a rectangular wedge form.

29. The method of claim 22 wherein the providing a waterproofing assembly includes providing the skirt made from a plurality of skirting pieces, the skirting pieces each having a split joint through the skirting piece, the split joint including a clasp and a locking slot, the locking slot fitted for the clasp, and interconnecting the skirting pieces in a generally watertight manner to form the skirt by locking the clasp of one skirting piece to the locking slot of the adjoining skirting piece.

30. The method of claim 22 wherein the deck post defines a first deck post, and further comprising securing a second deck post having a cross-section to a roof deck; and wherein the providing a waterproofing assembly includes the collar having a second opening having generally the same cross-section as that of the second deck post.

31. A method of constructing a waterproof roof desk post construction, comprising:

(a) providing a sleeve surrounding a lower portion of a deck post secured to a roof deck, the deck post having a non-circular cross-section;

(b) providing a waterproofing assembly including a collar and a skirt, the collar having an opening having generally the same non-circular cross-section as that of the deck post, the collar formed as a plug which is a separate piece from the skirt and adapted to be fitted into an opening in the skirt; and (c) positioning the waterproofing assembly such that the deck post extends through the opening in the collar and the skirt extends down over a top of the sleeve;

wherein the providing a waterproofing assembly includes-providing a circumferential shoulder on the skirt, the circumferential shoulder comprised of a plurality of flanged tabs, and connecting the collar to the skirt with the flanged tabs.

32. The method of claim 31 wherein the providing a waterproofing assembly includes providing the collar with a series of tab-receiving cavities and connecting the collar to the skirt by inserting the flanged tabs into the tab-receiving cavities.

33. The method of claim 31 wherein the providing a waterproofing assembly includes providing a projection on each of the plurality of flanged tabs, and inserting the flanged tabs on the skirt into the collar past the location of the projections on the flanged tabs so that the pull-out resistance between the collar and the skirt is increased.

34. The method of claim 31 further comprising after positioning the waterproofing assembly, applying a band around the collar to secure the collar in a generally watertight manner to the deck post.

35. The method of claim 34 wherein the applying a band around the collar includes placing the band within a clamping recess on the collar and then securing the band to the collar.

36. The method of claim 31 wherein the providing a waterproofing assembly includes the steps of providing a split joint through the skirt; the split joint including a clasp and a locking slot, opening the split joint, wrapping the skirt around the deck post at the top of the sleeve and locking the skirt in a generally watertight manner by inserting the clasp into the locking slot.

37. The method of claim 31 wherein the providing a waterproofing assembly includes the steps of providing a plurality of skirting pieces, the skirting pieces each having a split joint through the skirting piece, the split joint including a clasp and a locking slot, the locking slot fitted for the clasp, and then forming the skirt around the deck post at the top of the sleeve by locking the skirting pieces together in a ring formation by locking the clasp of one skirting piece into the locking slot of the adjoining skirting piece.

38. The method of claim 31 wherein the deck post defines a first deck post, the opening defines a first opening and the providing a waterproofing assembly includes the collar having a second opening having generally the same cross-section as that of a second deck post.

39. A waterproof roof deck post construction, comprising:

a deck post having a cross-section and secured relative to a roof deck;

a sleeve surrounding a lower portion of the deck post; and a waterproofing assembly including a collar and a frusto-conical skirt, the collar having an opening having generally the same cross-section as that of the deck post, the deck post being disposed in the opening, the collar formed as a plug, which is a separate piece from the skirt and adapted to be fitted into an opening in the skirt, the collar surrounding the deck post above a top of the sleeve, and the skirt extending down from the collar and out over the top of the sleeve;

the skirt having a single split joint angled relative to a longitudinal axis of the skirt, allowing the collar and skirt to be opened up, wrapped around an elongate member securable to a roof deck, and closed in a watertight manner with a male-female arrangement and with the collar generally above the skirt and secured thereto.

40. A waterproof roof deck post construction, comprising:

a deck post having a cross-section and secured relative to a roof deck;

a sleeve surrounding a lower portion of the deck post; and a waterproofing assembly including a collar and a frusto-conical skirt, the collar having an opening having generally the same cross-section as that of the deck post, the deck post being disposed in the opening, the collar formed as a plug, which is a separate piece from the skirt and adapted to be fitted into an opening in the skirt, the collar surrounding the deck post above a top of the sleeve, and the skirt extending down from the collar and out over the top of the sleeve;

wherein the skirt includes a plurality of skirting pieces, the skirting pieces each having a split joint through the skirting piece, the split joint including a clasp and a locking slot, the locking slot fitted for the clasp, the skirting pieces interconnected in a generally watertight manner to form the skirt by locking the clasp of one skirting piece to the locking slot of an adjoining skirting piece.

41. The construction of claim 40 wherein the cross-section is non-circular.

42. A method of constructing a waterproof roof desk post construction, comprising:

(a) providing a sleeve surrounding a lower portion of a deck post secured to a roof deck, the deck post having a cross-section;

(b) providing a waterproofing assembly including a collar and a skirt, the collar having an opening having generally the same cross-section as that of the deck post, the collar formed as a plug which is a separate piece from the skirt and adapted to be fitted into an opening in the skirt; and (c) positioning the waterproofing assembly such that the deck post extends through the opening in the collar and the skirt extends down over a top of the sleeve;

wherein the providing a waterproofing assembly includes providing a plurality of skirting pieces, the skirting pieces each having a split joint through the skirting piece, the split joint including a clasp and a locking slot, the locking slot fitted for the clasp, and then forming the skirt around the deck post at the top, of the sleeve by locking the skirting pieces together in a ring formation by locking the clasp of one skirting-piece into the locking slot of the adjoining skirting piece.

43. The method of claim 42 wherein the cross-section is non-circular.

44. A waterproof roof deck post construction, comprising:

a deck post having a cross-section and secured relative to a roof deck;

a sleeve surrounding a lower portion of the deck post; and a waterproofing assembly including a collar and a skirt, the collar having an opening having generally the same cross-section as that of the deck post, the deck post being disposed in the opening, the collar formed as a plug, which is a separate piece from the skirt and adapted to be fitted into an opening in the skirt, the collar surrounding the deck post above a top of the sleeve, and the skirt extending down from the collar and out over the top of the sleeve;

wherein the skirt includes a single split joint through the skirt, the split joint including a clasp and a locking slot, the locking slot fitted for the clasp, for closing the split joint in a generally watertight manner, the skirt being a continuous solid piece from one side of the split joint to the other; and wherein the skirt includes a circumferential shoulder having a plurality of flanged tab for connecting the collar and the skirt.

45. The construction of claim 44 wherein the collar is fitted with a series of tab-receiving cavities for accepting the plurality of flanged tabs.

46. The construction of claim 44 wherein the flanged tabs each include a projection for increasing the pull-out resistance between the connection of the collar and the skirt.

47. The construction of claim 46 wherein the clasp is a rectangular wedge.

* * * * *